US009783276B2

(12) United States Patent
Clement

(10) Patent No.: US 9,783,276 B2
(45) Date of Patent: Oct. 10, 2017

(54) SAILING FURLER AND METHOD

(71) Applicant: Stephen Colgan Clement, McLean, VA (US)

(72) Inventor: Stephen Colgan Clement, McLean, VA (US)

( * ) Notice: Subject to any disclaimer, the term of this patent is extended or adjusted under 35 U.S.C. 154(b) by 0 days.

(21) Appl. No.: 15/253,340

(22) Filed: Aug. 31, 2016

(65) Prior Publication Data

US 2017/0073053 A1 Mar. 16, 2017

Related U.S. Application Data

(60) Provisional application No. 62/216,745, filed on Sep. 10, 2015.

(51) Int. Cl.

| | |
|---|---|
| ***B63H 9/04*** | (2006.01) |
| ***B63H 9/08*** | (2006.01) |
| ***B63H 9/10*** | (2006.01) |

(52) U.S. Cl.

CPC ..... *B63H 9/1042* (2013.01); *B63H 9/04* (2013.01); *B63H 9/08* (2013.01); *B63H 2009/105* (2013.01)

(58) Field of Classification Search

CPC ..... B63H 9/04; B63H 9/10; B63H 9/1042; B63H 2009/105; B63H 9/08

USPC ..... 114/106, 104, 107, 108

See application file for complete search history.

(56) References Cited

U.S. PATENT DOCUMENTS

| | | | | |
|---|---|---|---|---|
| 88,543 | A | 4/1869 | Chambers | |
| 239,905 | A * | 4/1881 | Wilson | B63H 9/1028 114/106 |
| 2,197,654 | A | 4/1940 | Beaudry | |
| 3,260,230 | A | 7/1966 | Kauert | |
| 3,285,215 | A | 11/1966 | Potter | |
| 4,116,152 | A | 9/1978 | Larsson | |
| 4,324,192 | A | 4/1982 | Ingouf | |
| 4,449,468 | A | 5/1984 | Schulz et al. | |
| 4,503,797 | A | 3/1985 | Maurin | |
| 4,724,787 | A | 2/1988 | Chevalier et al. | |
| 4,741,281 | A | 5/1988 | Doyle | |
| 5,632,215 | A | 5/1997 | Moessnang et al. | |
| 5,634,420 | A | 6/1997 | Huisman | |
| 5,697,314 | A | 12/1997 | Clausin | |
| 6,145,460 | A | 11/2000 | Brookes | |

(Continued)

FOREIGN PATENT DOCUMENTS

| | | | |
|---|---|---|---|
| EP | 0553381 | A1 | 8/1993 |
| FR | 2609273 | A1 | 7/1988 |

*Primary Examiner* — Lars A Olson

(74) *Attorney, Agent, or Firm* — Schiff Hardin LLP

(57) ABSTRACT

A sail furler for a sail boat and method for furling a sail for reefing or storage and for unfurling a sail for use. Furling and unfurling of the sail may be accomplished from the cockpit of the sailboat. A mandrel is mounted to the mast extending generally parallel to the boom and attached to the aft end of boom by an aft plate. The mandrel is mounted in bearings and provided with a removable crank for rotation. The mandrel is connected to the mast by a universal joint and bearing structure over which is provided an outer cylinder. A cylinder and resilient sleeve may be provided on the mandrel. A reef brake extends from the mandrel into contact with the boom to prevent rotation for reefing the sail. A slide guard may be mounted at the mast end of the mandrel.

21 Claims, 22 Drawing Sheets

(56) References Cited

U.S. PATENT DOCUMENTS

| | | | |
|---|---|---|---|
| 6,953,000 | B2 | 10/2005 | Fink |
| 7,650,846 | B2 | 1/2010 | McKim |

* cited by examiner

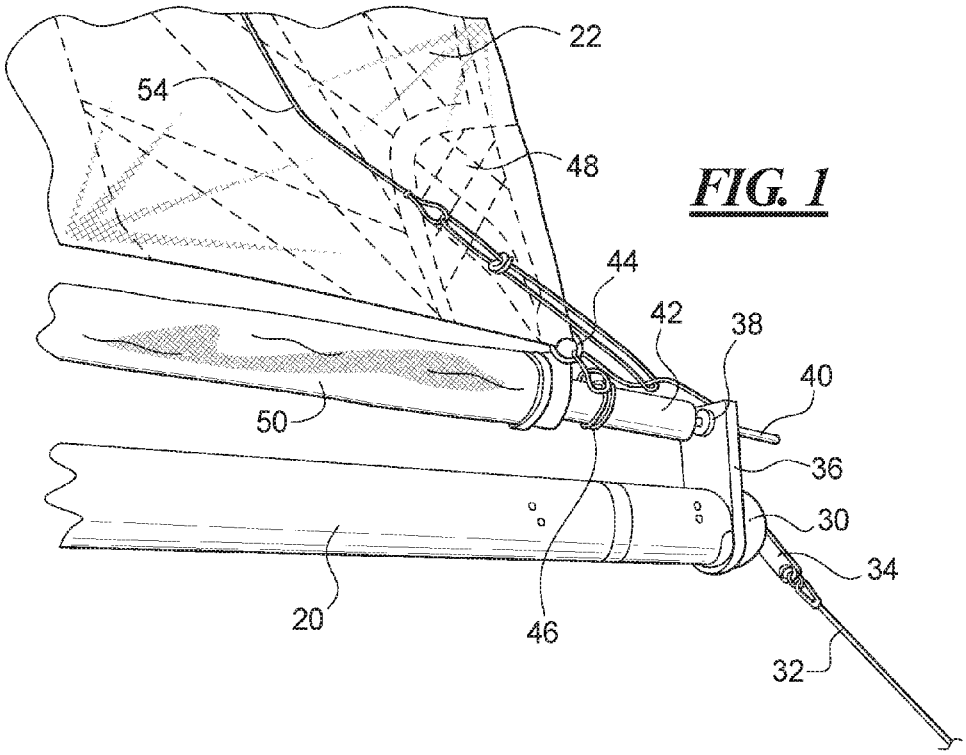
FIG. 1
FIG. 2
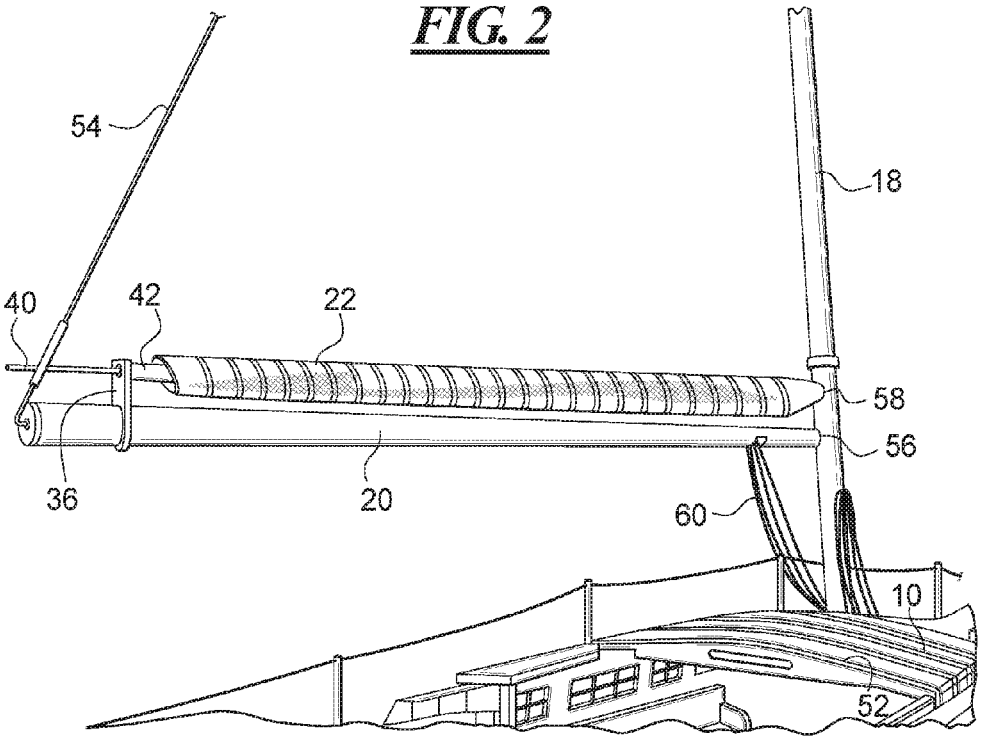

FIG. 8
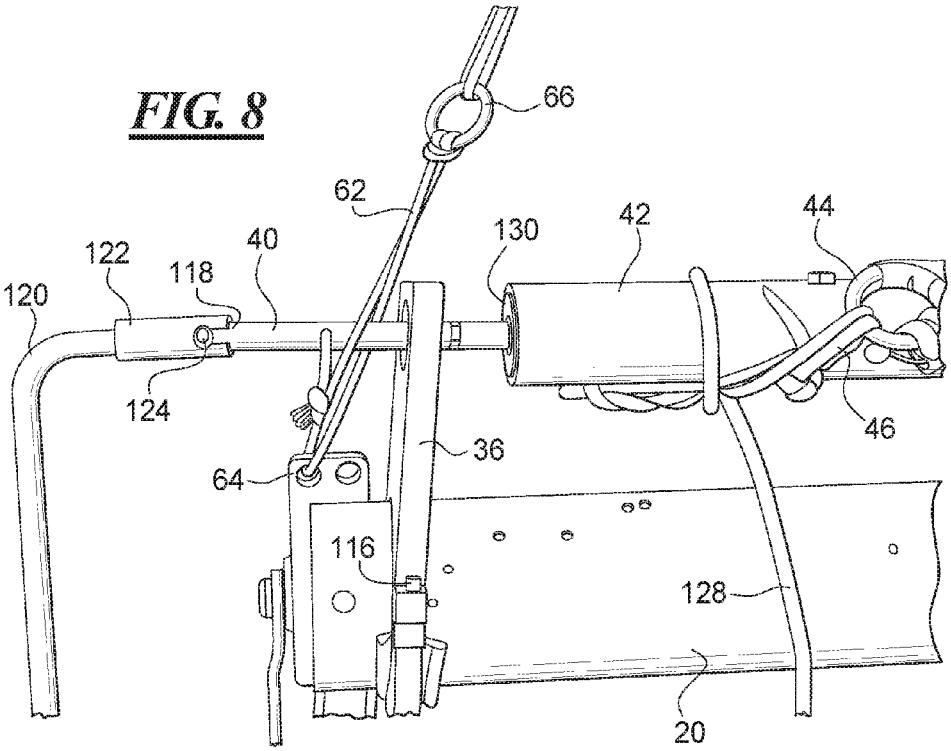
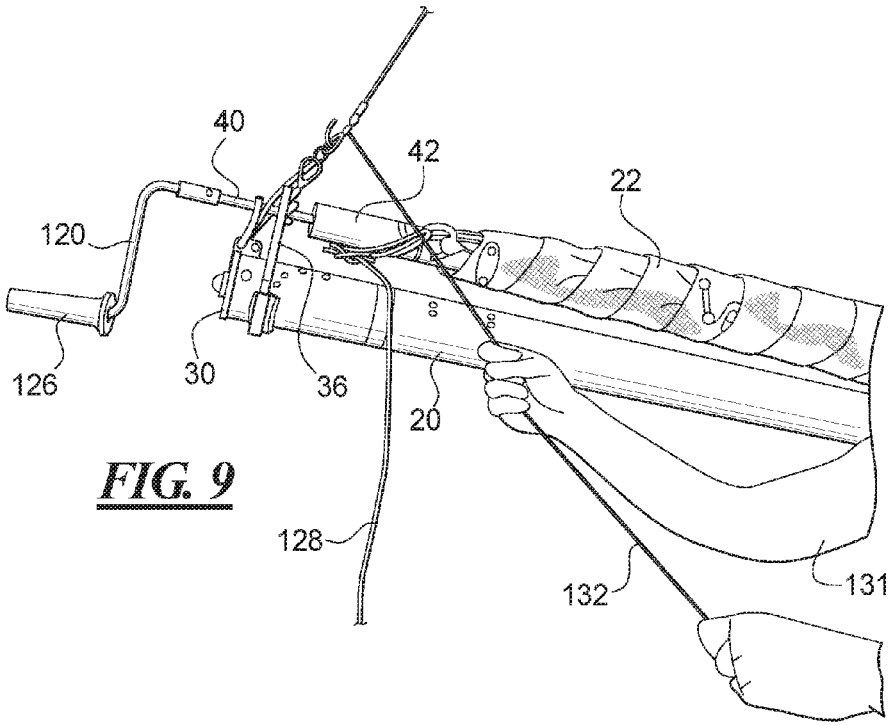
FIG. 9

FIG. 18
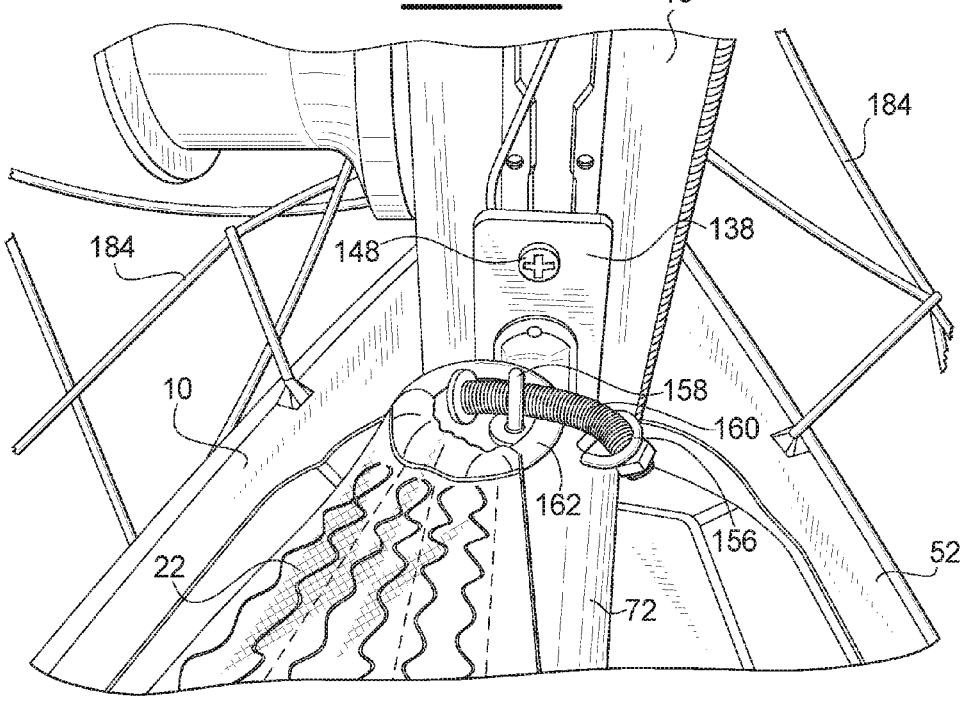
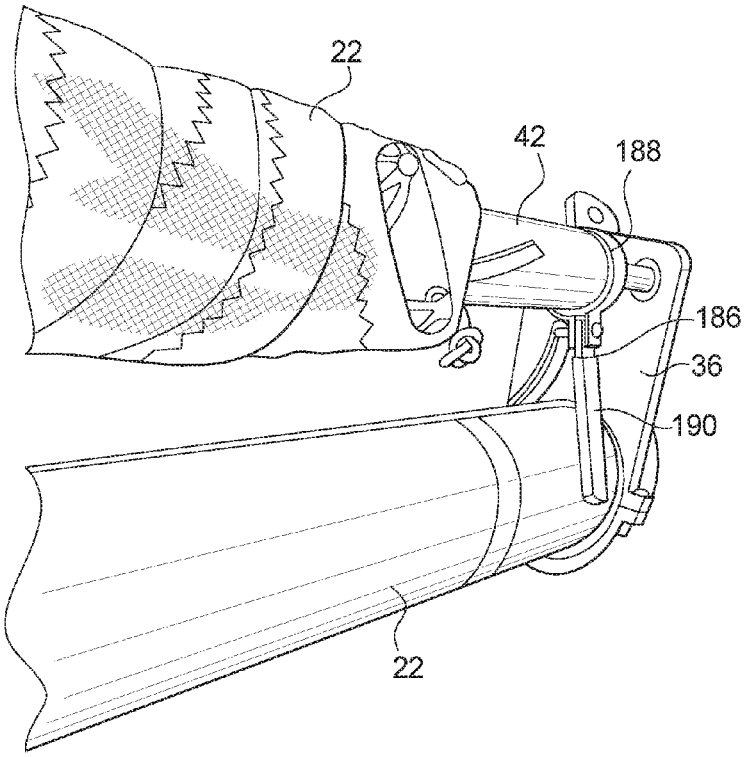
FIG. 19

SAILING FURLER AND METHOD

CROSS-REFERENCE TO RELATED APPLICATION

This application claims the benefit of U.S. Provisional Patent Application Ser. No. 62/216,745, filed Sep. 10, 2015, which is incorporated herein by reference.

BACKGROUND OF THE INVENTION

Field of the Invention

The present invention relates generally to an apparatus and method for deploying, retracting, and storing a sail of a sailboat, and more particularly to an apparatus and method for furling, storing, and unfurling a sail of a sailboat.

Description of the Related Art

Sailboats use sails that catch the wind as their primary or sole source of propulsion. Sails that are used on sailboats may include the mainsail, spinnaker, jib, and headsail, or genoa. The sails are supported by one or more masts, a vertical pole or spar that extends upward from the boat. The mainsail is also supported by a boom, a horizontal spar that attaches to the mast to support the bottom part of the mainsail. The sails are attached to various lines that hold them in place and apply tension to the sails, and that support the mast or other spar. The lines, or wires, have different names depending on their location and attachment, including headstay, backstay, shrouds, sheets, halyards, etc.

The mainsail is the primary source of power for the sailboat and is more easily controlled than other sails because it is attached to the mast and the boom. When not in use, sails are folded or rolled, referred to as furled, for storage. The mainsail may be folded and stored below the deck in a sail storage bag when not in use. Alternately, the mainsail may be folded or rolled on the boom and then covered by a sail cover for storage. After removing the storage bag from the mainsail and attaching the lower edge of the mainsail to the boom, if the sail was stored off the boom, the mainsail is raised, or hoisted, for use. After use, the mainsail is lowered and stored, either by flaking (accordion folding) the sail or by rolling. Rolling the mainsail involves the crew rolling the sail until it sits on the boom in a bundle.

Wind conditions may require that a sail be used with a reduced area. Reducing the area of the sail is referred to as reefing. Taking in the reef (reefing in) or taking out the reef to increase or decrease the sail area may be required as conditions change.

Deploying and retracting for the mainsail may require several crew members who are stationed at, or who move about to, different positions on the boat to handle the various tasks associated with raising and lowering the mainsail and with preparing the sail for use or for storage. Similarly, reefing the mainsail may require that the crew move about to various positions on the boat to accomplish the tasks associated with reefing.

It would be an improvement to provide an apparatus and method that simplifies the deploying, reefing, and stowing of a sail on a sailboat, such as the mainsail, jib or mizzen.

SUMMARY OF THE INVENTION

An apparatus and method for furling a sail for reefing or storage and for unfurling a sail for use is provided. In certain embodiments, the furling and unfurling of the sail may be accomplished from the cockpit of the sailboat. Handling the sail is simplified.

BRIEF DESCRIPTION OF THE DRAWINGS

FIG. 1 is a perspective view showing a portion of a boom with a sail furler and mainsail in a deployed condition;

FIG. 2 is a perspective view of a mast and boom on a sailboat with the mainsail furled on a sail furler;

FIG. 8 is an enlarged side view of an aft end of the boom and sail furler;

FIG. 9 is a side view of the boom and sail furler lifted higher than the mast attachment;

FIG. 18 is an enlarged perspective view of a tack connector that connects a forward lower corner of a sail to the sail furler;

FIG. 19 is a perspective view of a reefing brake on the sail furler;

DETAILED DESCRIPTION OF THE PREFERRED EMBODIMENTS

Figure 25:
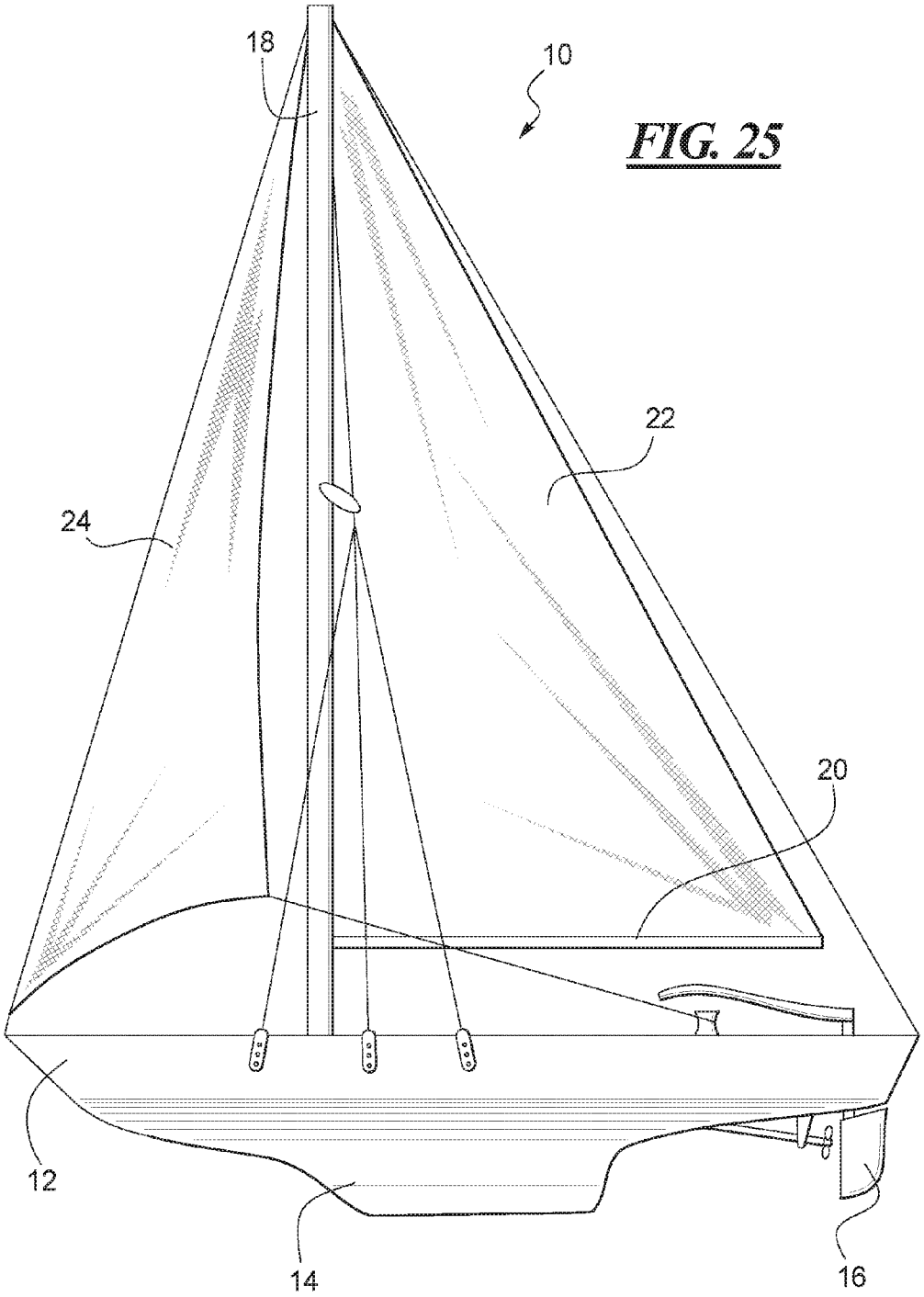
FIG. 25 is a side view of a sailboat.

Referring first to FIG. 25, a sailboat 10 has a hull 12 below which is a keel 14 and at the rear of which is a rudder 16. A mast 18 or vertical spar extends vertically from the hull 12. A boom 20 or horizontal spar extends from the mast in a generally horizontal orientation. A mainsail 22 is supported between the mast 18 and the boom 20. In addition to the mainsail 22, the illustrated sailboat has a second sail, here a jib sail 24. Other features of the sailboat are shown but are not discussed further here.

In FIG. 1, the boom 20 extends generally horizontally above the deck of the sailboat 10 from the mast 18 to a free end 30. In this example, a line 32 which may be referred to as a mainsheet cable, is connected to the free end 30 of the boom 20. The line or mainsheet 32 may be connected to the hull, deck or other connection location on the sailboat. The line 32 connects to a plate 34 mounted on the end 30 of the boom 20. An aft plate 36 is mounted adjacent the end 30 of the boom 20. The aft plate 36 extends around the boom 20 and includes a portion that extends vertically from the boom 20. The vertical extension is provided with an opening in which is mounted a bearing 38. A mandrel 40 extends through the aft plate 36 and is supported by the bearing 38. The mandrel 40 may be a rod of stainless steel or carbon fiber or other materials. In an example, the mandrel 40 is ½ to ¾ inch in diameter. The mandrel 40 is mounted to extend about 6 to 12 inches beyond the end of the boom 20 in certain embodiments. The mandrel 40 may be configured for attachment of a hand crank or furling drum at the aft end, and may be formed or drilled to receive pins or other attachments.

On the mandrel 40 is a cylinder 42 that is generally co-axial of the mandrel 40. The cylinder 42 of certain embodiments is formed of aluminum or may be of other materials such as carbon fiber, etc. The cylinder 42 may be approximately one foot longer than the sail foot, or bottom edge of the sail, and may be about on foot shorter than the mandrel 40. The cylinder 42 may be hollow and may be mounted on to the mandrel 40 by spacers (not shown) that extend between the mandrel 40 to the interior surface of the cylinder 42. In certain embodiments, a plurality of spacers is provided along the length of the mandrel 40 and cylinder 42. The spacers may be of plastic or hardwood or other materials and may be secured in place within the cylinder 42 by glue, pins, or other fasteners. The fasteners, such as pins, may extend through the wall of the cylinder 42 and into and/or through the mandrel 40. The spacers and fasteners transmit rotational motion of the mandrel 40 to the cylinder 42.

The aft end or clew of the mainsail 22 is attached to the cylinder 42 by a ring, eye, or cringle 44 at the corner of the sail 22. In the illustration, the eye 44 is fastened to the cylinder 42 by a strap 46 that may be applied and tightened for brisk wind conditions. An outhaul line may be threaded through the eye 44 and through an eye or cleat at the aft end of the cylinder 42. The outhaul line 46 permits the tension on the foot of the sail 22 to be adjusted. The sail 22 is shown in its deployed position. Reinforcing stitching 48 may be seen in the sail 22. A clew topping lift line 54 is shown as the slack line in the figure.

In certain embodiments, a sleeve 50 is provided on the cylinder 42. The sleeve 50 may be of foam rubber or other material and may provide a resilient surface on which the sail 22 may be wound. The sleeve 50 may permit even furling of the sail along the mandrel 40 to reduce or prevent creases in the sail when furled. The sleeve 50 may be provided on all or only a portion of the cylinder 42, depending on the cut of the sail 22. The resilient sleeve 50 applies mild tension to the leech or tailing edge of the sail 22 during furling for sails with luff slides at the forward edge of the sail. The tension results in the luff or forward edge of the sail 22 rolling onto the mandrel 40 slightly aft of the mast attachment. This prevents the luff slides from getting caught in the rotational movement of the mandrel. If the sail 22 is fitted with luff tape instead of luff slides, the resilient sleeve 50 may allow for smoother raising and lowering of the sail 22.

The sail furler is shown in the examples mounted parallel to the boom 20 of the sailboat. The sail furler may be mounted at any spar, pole, bar, or other elongated member used for supporting a sail, all of which are encompassed within the term "boom" as used herein. The sail furler is shown in the examples for controlling a lower edge of a mainsail and for rolling the mainsail 22 of the sailboat 10. The sail furler may be used for controlling the lower edge or another edge of another sail and for rolling another sail on the sailboat. The sail furler as shown includes an aft plate to hold the mandrel to the boom or spar. Other devices, structures and means may be provided instead to support the mandrel, all of which are encompassed within the term "aft plate" as used herein. The sail furler is shown configured for retrofit onto the mast, boom, and rigging of an existing sailboat 10. The sail furler may be provided as a kit for installation on a sailboat. The sail furler may be installed, for example, by a retrofitter or boat builder, on a new or existing sailboat. The sail furler may be removed from and reinstalled onto the sailboat as desired. The sail furler may be provided as original equipment on the sail boat when new.

FIG. 2 shows the sailboat 10, and in particular a deck 52 of the sailboat 10, from which extends the mast 18. The boom 20 extends horizontally from the mast 18. A line 54 extends from the end 30 of the boom 20 to the mast 18 to support the boom 20. The mandrel 40 extends through the aft plate 36. The mainsail 22 is wound or furled onto the cylinder 42 for storage. The cylinder 42 and mandrel 40 are mounted parallel to the boom 20 and spaced from the boom 20 by a distance sufficient to permit the sail 22 to be wound on the cylinder 42 without interference by the boom 20. The boom 20 is attached to the mast 18 at 56. The mandrel 40 is attached to the mast 18 at 58. A boom yang rigging 60 that may include block and tackle is connected from the boom 20 to the base of the mast 18.

Figure 3:
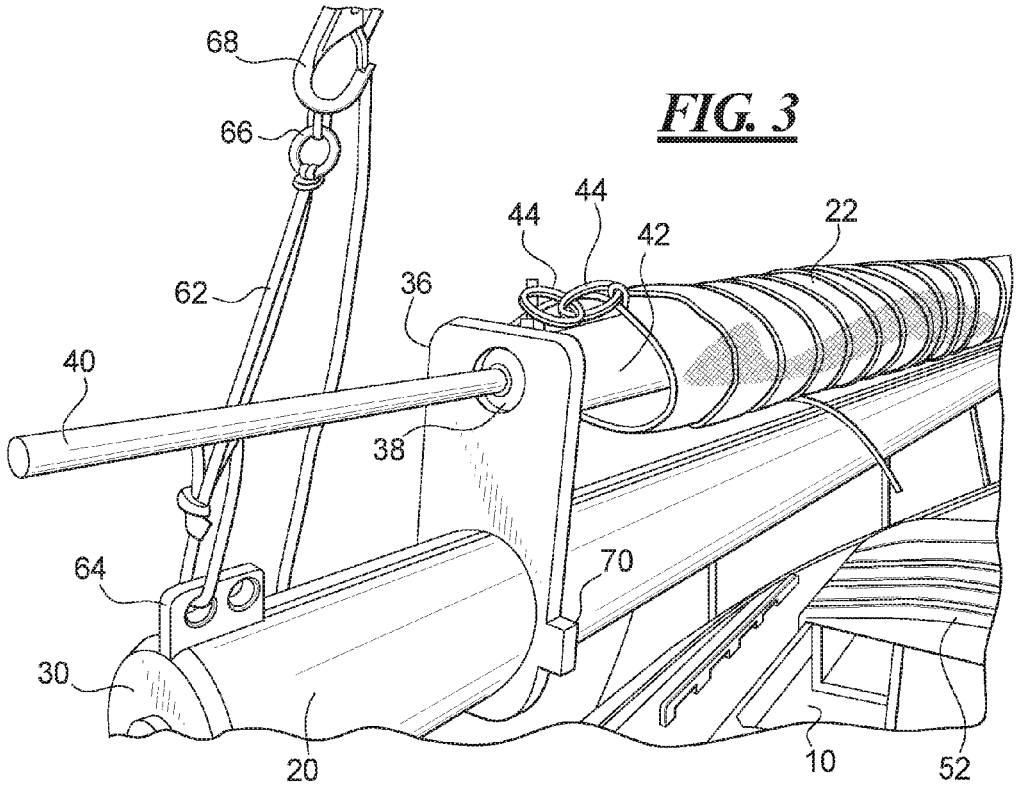
FIG. 3 is an enlarged perspective view of an end of the sail furler and boom with the mainsail furled on the sail furler.

In FIG. 3 is shown the boom 20 generally from the free end 30 on which the aft plate 36 is mounted. The mandrel 40 extends through the bearing 38 so that the mandrel 40 may rotate in the aft plate 36. The mainsail 22 is shown wound onto the cylinder 42. Rings 44 for connecting the sail 22 to the cylinder 42 are apparent in this view. A line 62 connects the end 30 of the boom 20 to the mast 18. The line 62 is connected through an eyelet 64 provided on the end 30. The eyelet 64 of the illustration includes two eyelet openings. The line 62 connects to a ring 66 which in turn is connected to clip hook 68. The aft plate 36 includes a laterally projecting tab 70 in the illustrated embodiment. In certain embodiments, screws extend through the tab 70 to connect two portions of the aft plate together so as to secure the aft plate to the boom 20. A similar tab 70 may extend from the opposite side.

Figure 4:
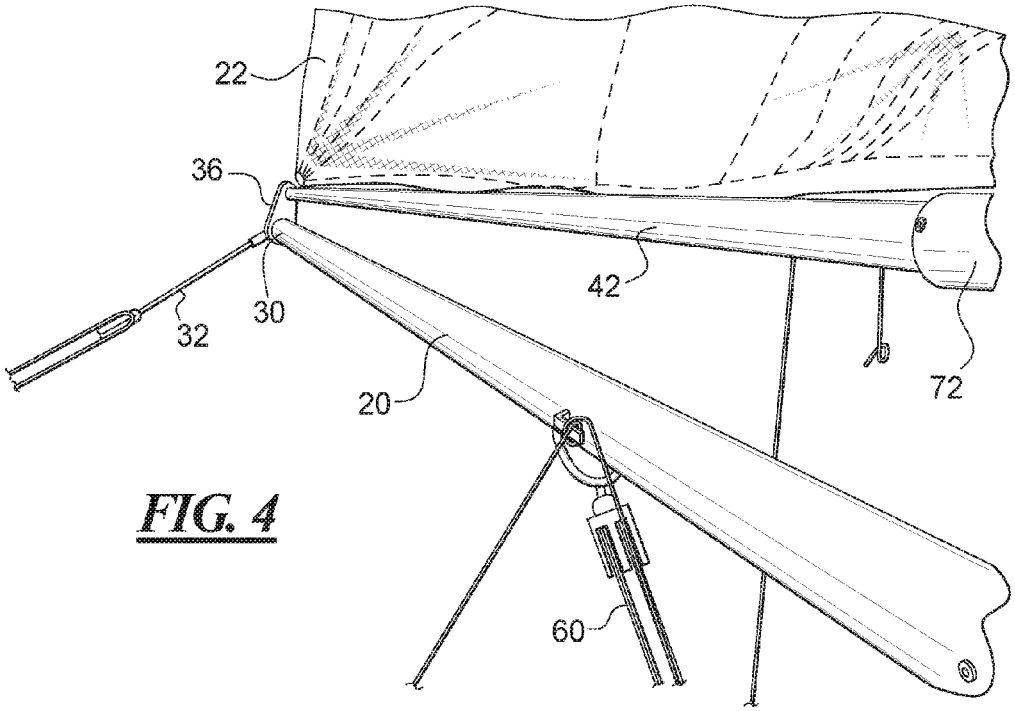
FIG. 4 is a perspective view of the boom and sail furler viewed generally from the mast.

FIG. 4 shows the boom 20 generally from the position of the mast 18. The boom yang rigging 60 is connected to the boom 20. The line or mainsheet 32 is connected at the free end 30 of the boom 20. The cylinder 42 of the sail furler extends generally parallel to the boom 20 and does not interfere with the operation of the boom 20 or with the boom yang 60 or mainsheet line 32. The mainsail 22 is deployed or set and extends above the cylinder 42 and mandrel 40. The mandrel 40 and sail 22 are set at a broad reach in this view. The fore end of the cylinder 42 adjacent to the mast 18 includes an outer cylinder 72. The aft end of the mandrel 40 and boom 20 are connected by the aft plate 36.

Figure 5A:
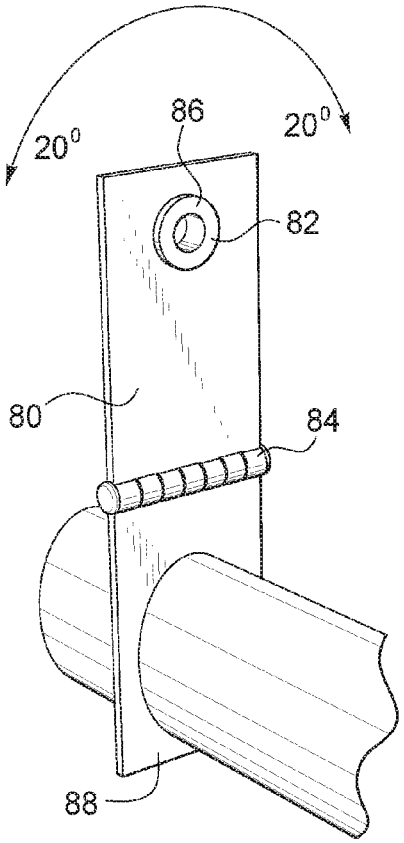
FIG. 5*a* is a perspective view of an aft plate of the sail furler on a boom.
Figure 5B:
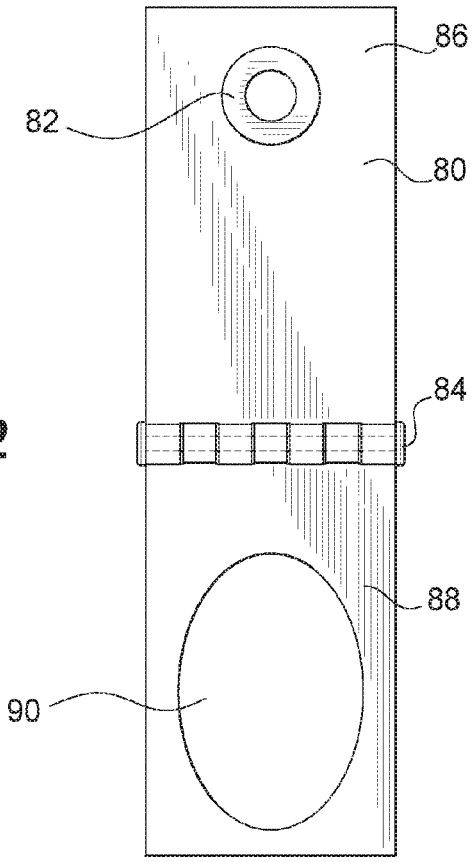
FIG. 5*b* is a plan view of the aft plate of FIG. 5*a;*

FIGS. 5*a* and 5*b* show an alternate embodiment of an aft plate 80. FIG. 5*a* shows the aft plate 80 mounted on the boom 20 adjacent to the free end 30. The aft plate 80 extends upward from the boom 20 and includes an opening in which is mounted a bearing 82. The aft plate 82 includes a hinge 84 by which an upper portion 86 of the aft plate 82 may bend or pivot relative to a lower portion 88 that is mounted on the boom 20. In certain embodiments, the upper portion 86 and lower portion 88 are pivotable over a range of plus or minus 20 degrees. The 40 degree range is sufficient for most sailboats. The pivoting movement may avoid the need for sliding movement of the mandrel 40 in the aft plate 36. FIG. 5*b* shows the aft plate 80 off of the boom. An opening 90 is provided in the lower portion 88 to fit onto the boom 20. The bearing 82 is provided in the upper portion 86. The hinge 84 of the illustrated embodiment is provided with a hinge pin by which the pivoting may be accomplished, although other pivoting or bending structures are possible as well. In this embodiment and others, the bearing 82 may be a spherical bearing which permits the mandrel 40 to tilt relative to the plane of the aft plate 80 by rotation of the bearing 82 as the aft plate 80 and the mandrel 40 are moved to different angles.

Figure 6A:
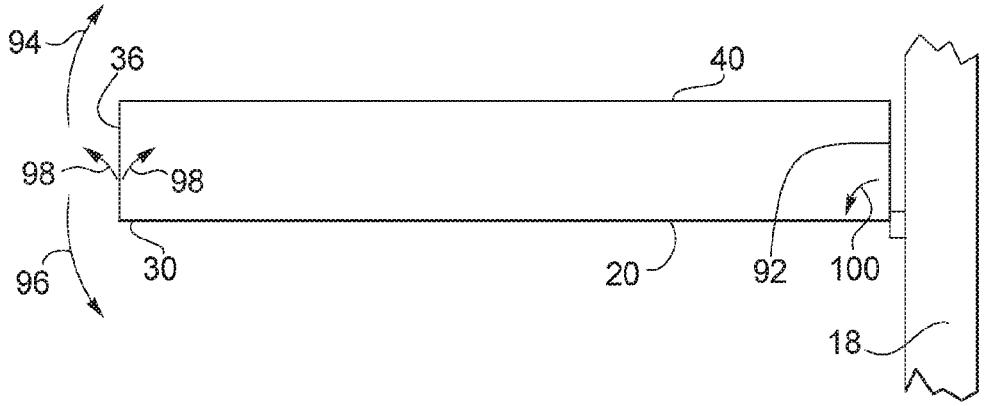
FIGS. 6*a*, 6*b* and 6*c* are schematic diagrams of a parallelogram formed by the boom and sail furler.

FIG. 6*a* shows a schematic diagram of a mast 18 and boom 20 on which are provided a mandrel 40 of the sail furler. In the diagram, the boom 20 and mandrel 40 are represented by the respective axes. Both the boom 20 and mandrel 40 extend perpendicular from the mast 18 in FIG. 6*a*. The aft plate 36 is connected between the boom 20 and mandrel 40 at the aft end or end farthest from the mast 18. A mast plate 92, which may be a hinged mast plate, is connected between the boom 20 and mandrel 40 at the fore end nearest the mast 18. The mast plate 92 and aft plate 36 may pivot relative to the boom 20 to permit movement of the free end 30 of the boom 20 as indicated by arrows 94 and 96, for example during tack adjustments. The pivoting movement is shown by the arrows 98 and 100.

Figure 6B:
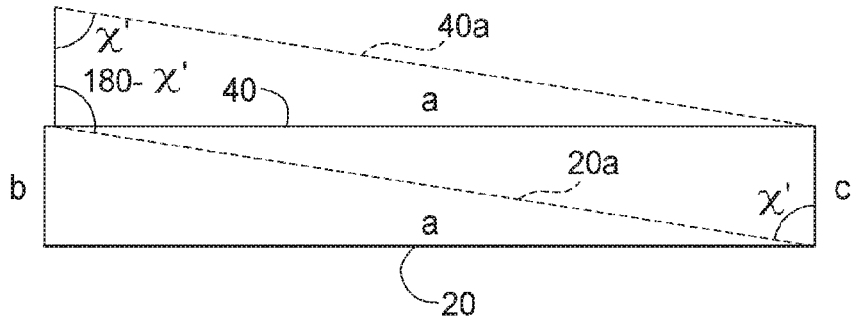
Figure 6C:
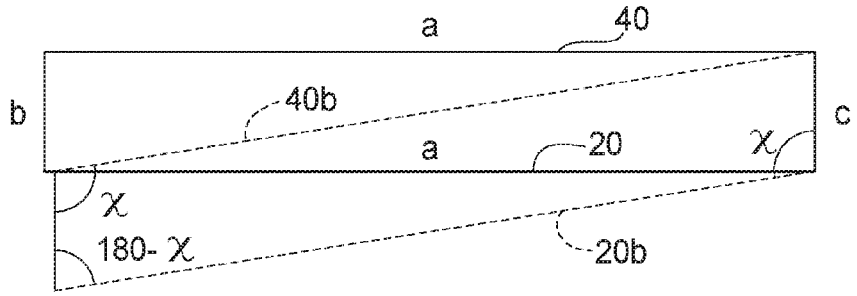

FIG. 6*b* shows the change in the boom 20 and mandrel 40 when the boom 20 is moved upward to boom and mast positions 20*a* and 40*a*, and FIG. 6*c* shows the change in the boom 20 and mandrel 40 when the boom 20 is moved downward to boom and mast positions 20*b* and 40*b*. The mast plate 92 and aft plate 36 may be hinged to permit the boom 20 to move up or down.

Figure 7:
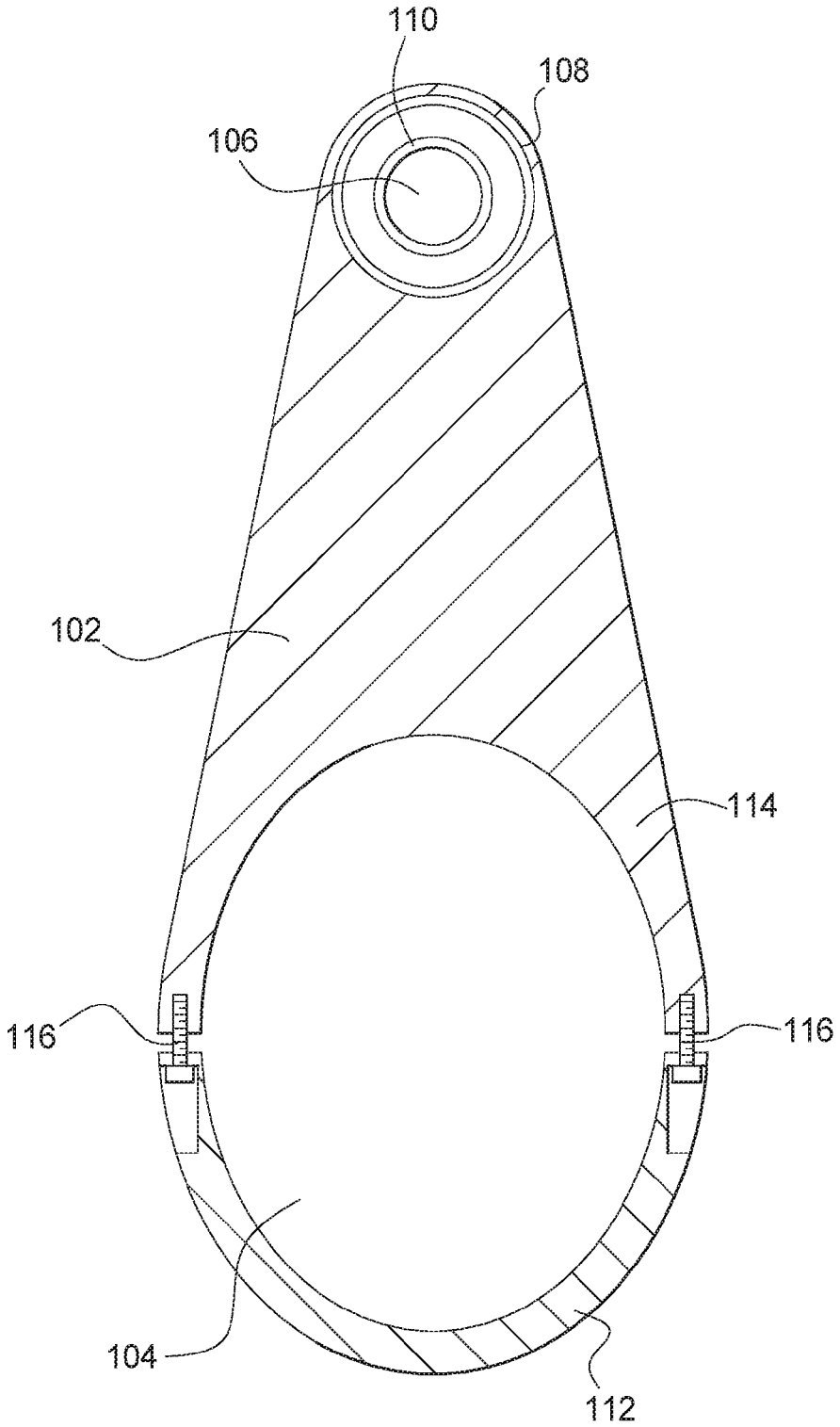
FIG. 7 is a top plan view of a bearing assembly positioned on a diagram of the aft plate.

In FIG. 7 is shown a diagram of another embodiment of an aft plate 102 having a tapered configuration tapering from a greater width at an opening 104 for receiving the boom 20 to a smaller width at a bearing 106. The opening 104 is oval to match the cross sectional shape of the boom 20. In the example, the opening 104 is shaped to fit a boom 20 on a Catalina 27 sailboat with a 3.5 inch vertical and 2.75 inch horizontal shaped boom. The opening 104 may be formed to fit any size and shape of boom 20 including shapes other than oval mast cross sections such as octagonal booms and rectangular booms, or inserts may be provided to customize the aft plate to a particular boom 20. In one example, plastic inserts are provided.

The bearing 106 includes an outer sleeve 108 and an inner sleeve 110. The bearing 106 may be positioned 3 to 6 inches above the top of the boom 20. The bearing 106 is constructed to permit rotation of the mandrel 40 in the bearing 106 and to permit the inner sleeve 110 to slide along the mandrel 40 as the boom 20 is lifted or lowered. The aft plate 102 is attached to the boom 20 by removing a lower portion 112 from an upper portion 114 using screws 116, positioning the upper and lower portions 114 and 112 on the top and bottom of the boom 20, and then fastening the portions 112 and 114 to one another using the screws 116, such as machine screws, to secure the portions onto the boom 20.

The aft plate may be formed of aluminum, stainless steel, carbon fiber, composite materials, or other material. In certain embodiments, the aft plate 36 is ½ to 1 inch thick. The aft plate 36 is provided with an opening that is shaped to fit the boom 20 or to accommodate inserts that fit the boom. The materials and fastenings of the aft plate 36 are designed to withstand the full upward, sideward, aft and forward forces of the normal clew attachment under full sail and high wind conditions.

In FIG. 8 is shown the boom 20 and aft plate 36 on which are mounted the mandrel 40 and cylinder 42. One of the screws 116 may be seen fastening the two portions of the aft plate 36 onto the boom 20. The mandrel 40 includes an end 118 to which is attached a crank 120. The crank 120 is attached to the end 118 by a slotted sleeve 122 that fits onto the end 118 and receives a pin 124 in the slot of the sleeve 122. Other attachments for the crank 120 are also possible. The crank 120 may be easily attached to and detached from the mandrel 40. The crank 120 may be removed from the mandrel 40 except when furling the sail. The crank 120 may be provided as a back-up for other systems for rotating the sail furler. Other systems for rotating the sail furler may include a furling line as described herein or a motorized system for rotating the sail furler.

The clew eye, cringle, or ring 44 of the sail 22 is attached to the cylinder 42 with the line or outhaul 128. A spacer 130 is visible extending between the mandrel 40 and the cylinder 42.

FIG. 9 shows the crank 120 attached to the mandrel 40. The crank 120 includes a handle 126 by which a user may rotate the mandrel 40 and cylinder 42 to wind or furl the mainsail 22 onto the sail furler. A line 128, which may be an outhaul line, extends from the cylinder 42 on which the sail 22 is wound. A sailor or other user 131 is applying tension to a line 132 resulting in the boom 20 being raised at an angle above horizontal. The boom 20 may be raised by the force of the wind on the sail 22 or by other forces as well. The mandrel 40 slides in the bearing of the aft plate 36 so that the aft plate 36 slides along to mandrel 40 to move closer to the end of the cylinder 42 in the raised position. The sliding movement of the mandrel 40 in the aft plate 36 permits the movement shown in FIGS. 6*a*-6*c* without requiring a pivoting aft plate.

The line 128, which may be an outhaul line, may be wound onto the cylinder 42 as the sail 22 is wound onto the cylinder 42. As an option for example in a smaller boat, the excess outhaul line may be used when the user or sailor 131 wishes to unwind the sail 22, the user may apply tension to the line 128 which results in the cylinder 42 rotating in an unwinding direction. Tension on the line 128 may assist in unwinding or unfurling the sail 22 in conjunction with other unfurling means, such as tension applied to the top or head of the sail 22. The sail 22 may be unfurled from the mandrel 40 without requiring that the user 131 rotate the crank 120 for unfurling. The line 128 may be run through guides and pulleys, for example extending along the boom 20 so that the sail 22 may be unfurled from the cockpit of the sailboat 10 without the need for the user to be positioned at the end 30 of the boom 20. Unfurling of the sail 22 may be performed without connecting the crank 120 to the mandrel 40. Of course, the sail 22 may also be furled and unfurled using the crank 120, or using a furling motor, furling drum, or other means.

Figure 10:
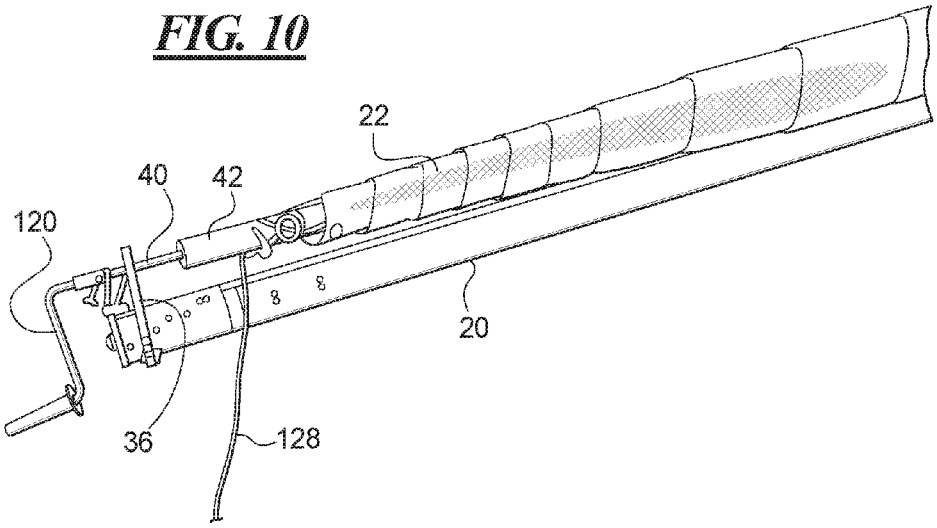
FIG. 10 is a side view of the boom and sail furler lowered below the mast attachment.

With reference to FIG. 10, the boom 20 is moved to a position below horizontal. As the boom 20 is moved vertically for example from a horizontal position to the raised position of FIG. 9 and to the lowered position of FIG. 10, the mandrel 40 slides in the bearing 38 of the aft plate 36. In the illustration of FIG. 10 the mandrel 40 has slid in the aft plate 36 so that the aft plate 36 is farther from the end of the cylinder 42 than in the horizontal position of FIG. 8 or the raised position of FIG. 9.

Figure 11:
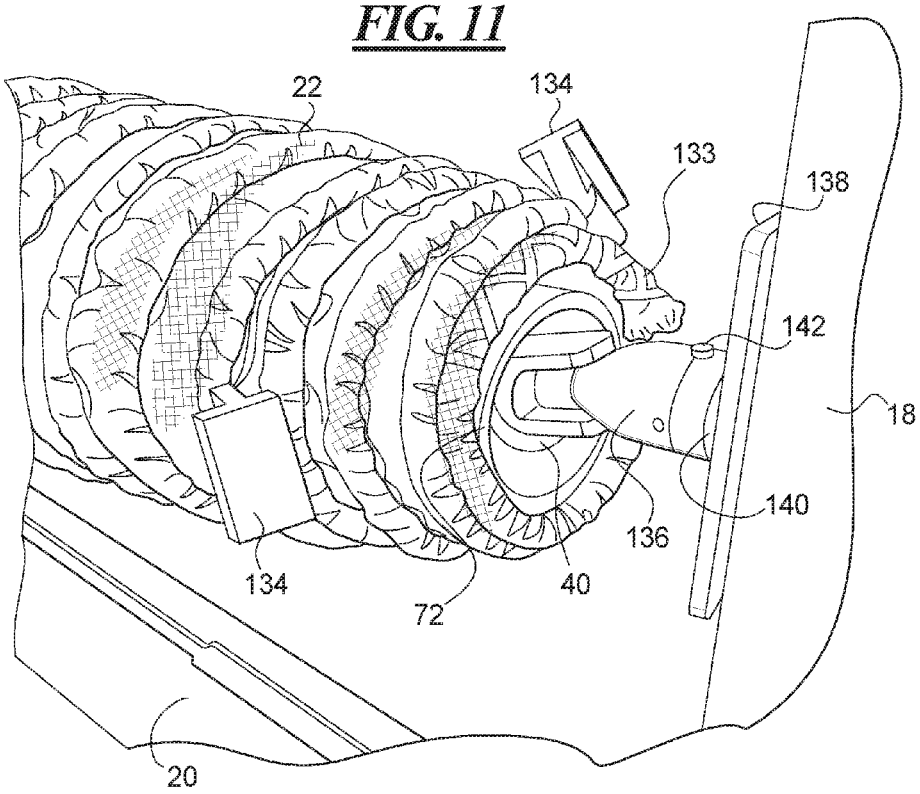
FIG. 11 is an enlarged perspective view of an inner mast attachment of the sail furler with the mainsail furled on the sail furler.

The sliding movement of the mandrel 40 in the aft plate 36 as the boom 20 is raised and lowered is the result of both the boom 20 and the mandrel 40 being attached to the mast 18, in certain embodiments. In FIG. 11, the end of the mandrel 40 adjacent the mast 18 is shown with the mainsail 22 furled thereon. The tack or forward lower corner of the sail 22 is attached to the mandrel 40 and the sail 22 is wound or furled onto the mandrel 40. The forward edge or luff 133 of the sail 22 is provided with luff slides 134 that slide along a track on the mast 18. In certain embodiments, the luff slides are nylon slides. As the sail 22 is wound onto the mandrel 40, the luff edge 133 and luff slides 134 are wound onto the mandrel 40. As noted above, the resilient sleeve 50 may help the sail to wind onto the mandrel with the luff aft of the mast attachment. This prevents the luff slides from getting caught in the rotational movement of the mandrel 40.

A universal joint 136 connects the mandrel 40 to a mast plate 138 that is mounted to the mast 18. The mast plate 138 includes a projection 140 onto which the universal joint is fastened, such as by a screw 142. The universal joint 136, mast plate 138 and other parts may be of stainless steel in certain embodiments. The outer sleeve 72 extends about the universal joint to prevent the sail 22 from contacting the universal joint 136. The universal joint allows the mandrel 40 to swing laterally from 90 degrees to port to 90 degrees to starboard of the mast as well as to pivot upward or downward.

Figure 12:
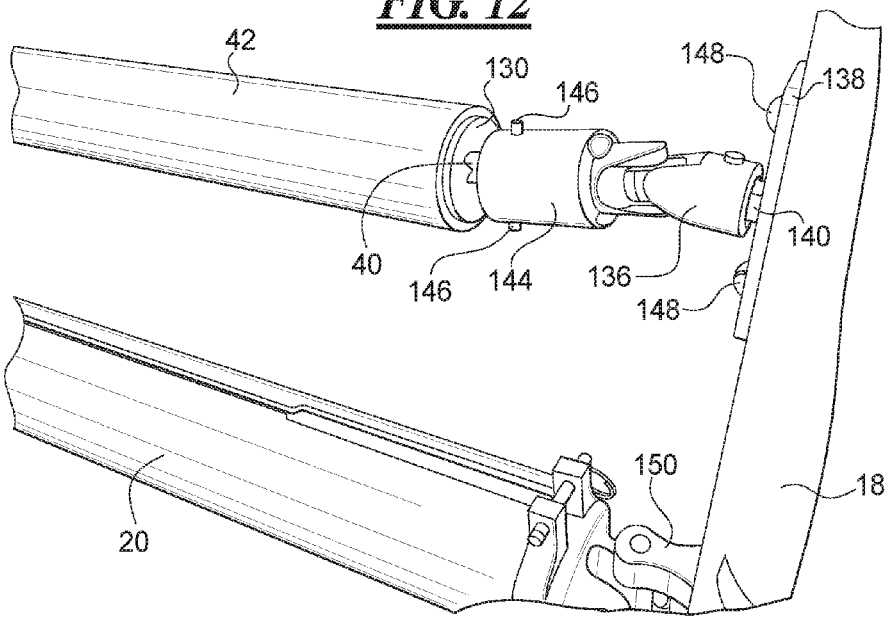
FIG. 12 is an enlarged perspective view of the inner mast attachment of the sail furler shown without the sail and without an outer cylinder.

Turning to FIG. 12, the mast plate 138 is attached to the mast 18, and the universal joint 136 is attached to the projection 140 of the mast plate 138. The universal joint 136 is connected to a barrel 144 within which is mounted a bearing. The bearing within the barrel permits the mandrel 40 and cylinder 42 to rotate. A spacer 130 maintains the spacing of the cylinder 42 on the mandrel 40. Fasteners 146 such as steel pins are provided to attach the bearing in the barrel 144. The end of the mandrel 40 extends through the bearing and is provided with a retaining ring to secure the mandrel 40 in the bearing. The sail furler may be attached to the sailboat 10 by the user when desired, for example, for recreational sailing, and may be detached when not needed, such as during sailboat racing. The mast plate 138 is attached to the mast 18 by bolts 148. The universal joint 136 is shown without the outer cylinder 72 that ordinarily covers the universal joint. The mandrel 40 is shown without the mainsail 22 mounted thereon.

The boom 20 is shown attached to the mast 18 by a gooseneck 150. The illustrated boom 20 includes a channel 152 running along a top thereof.

Figure 13:
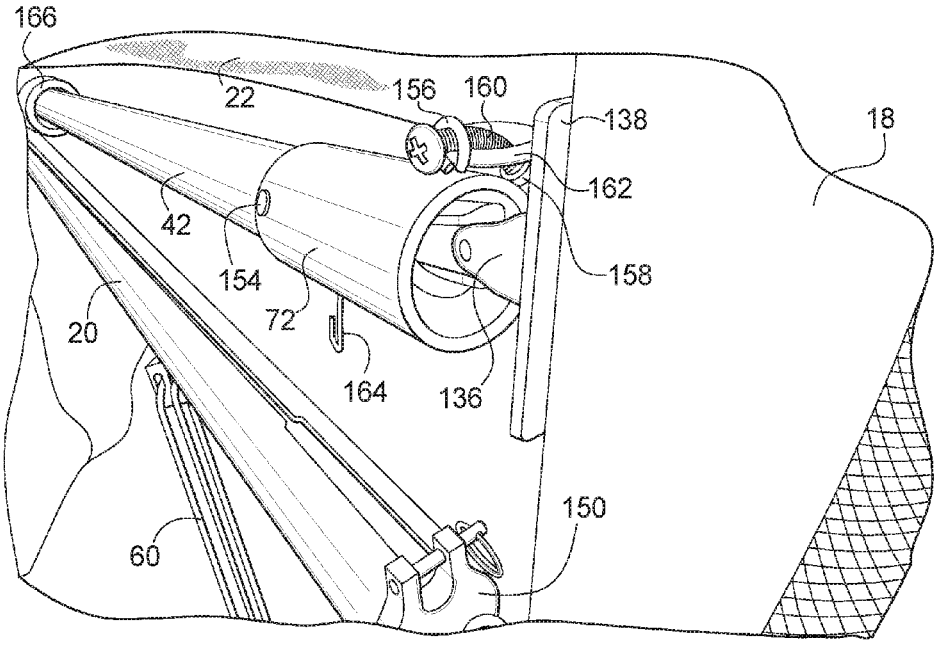
FIG. 13 is an enlarged perspective view of the inner mast attachment of the sail furler shown with an outer cylinder.

With reference to FIG. 13, the outer cylinder 72 is mounted over the universal joint 136. The outer cylinder 72 is attached to the cylinder 42 by a fastener 154. The outer cylinder 72 is of sufficient inside diameter to permit the universal joint to move about as needed for movement of the mandrel 40 and cylinder 42. The outer cylinder 72 is provided with spaced rings 156 and 158 through which extends a curved connector 160. The curved connector 160 of the illustrated embodiment is a threaded bolt that has been bent into a curve and onto which a nut is attached. The front lower ring or tack cringle 162 of the sail 22 is fastened to the outer cylinder 72 by passing the curved connector 160 through the first ring 156 of the outer cylinder 72, through the tack cringle 162, and through the second ring 158 of the outer cylinder 72. The nut is attached to the threaded bolt of the curved connector 160 to attach the lower front corner of the sail to the outer cylinder 72 of the mandrel 40. The curved bolt 160 may be replaced by non-stretch line extending through the rings 156 and 158 and the tack cringle 162.

An end of a line or rope 164 may be seen behind the outer cylinder 72. Various lines and ropes are used on sailboats for a variety of purposes, as will be appreciated by those of skill in this art. A sleeve 166 may be mounted on the cylinder 42.

Figure 14:
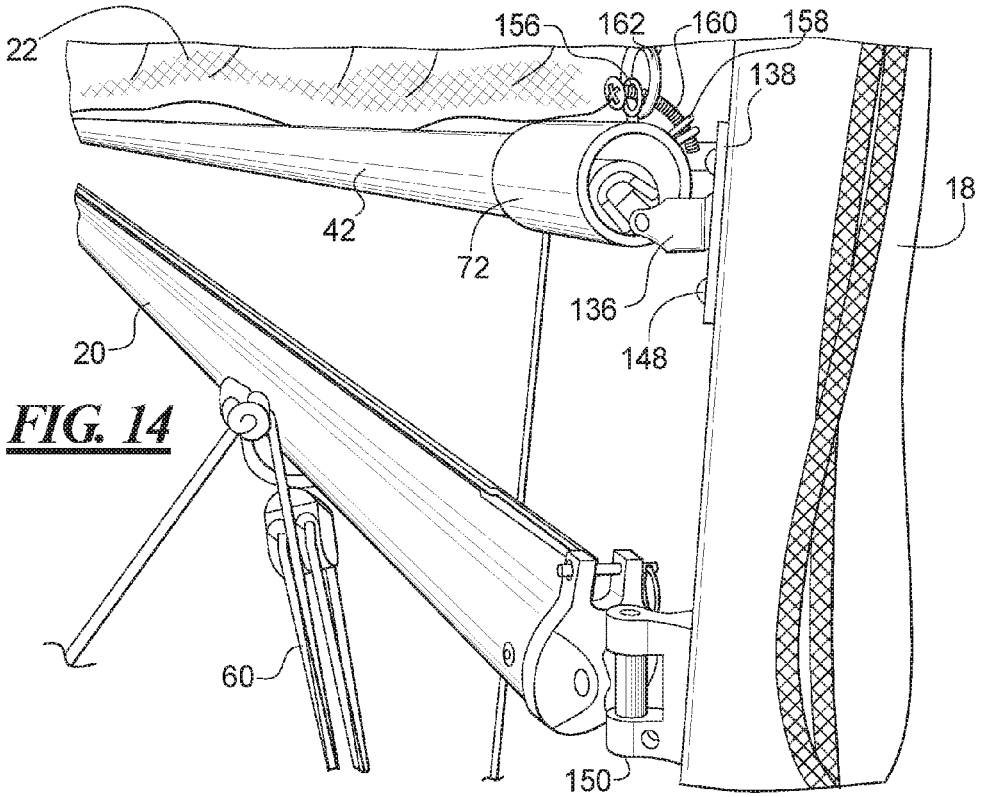
FIG. 14 is an enlarged perspective of the inner mast attachment of the sail furler and outer cylinder showing gimble movement.

FIG. 14 shows the universal joint 136 flexing within the outer cylinder 72. The universal joint 136 may flex as needed within the outer cylinder 72. The tack cringle 162 is mounted on the curved connector 160. The curved connector 160 that is mounted between the first and second rings 156 and 158 permits the tack cringle 162 of the sail to move about as needed. The distance between the boom 20 and the mandrel 40 and cylinder 42 may be set by the user or may be adjusted as needed. Depending on the sail used, the spacing may range, for example, from 4 inches to 12 inches to accommodate sails of different thickness. For example, the gooseneck 150 of the boom 20 may be adjusted vertically on the mast 18. When the sail is fully raised, the gooseneck 150 may be raised to abut the mandrel 40 and thus provide more headroom for the sailors. When the sail 22 is fully furled on the mandrel 40, the gooseneck 150 may be moved away from the mandrel 40 to provide space for the sail. The spherical bearing in the aft plate 36 permits the change in spacing of the mandrel 40 and boom 20, particularly when using a hinged aft plate.

Figure 15:
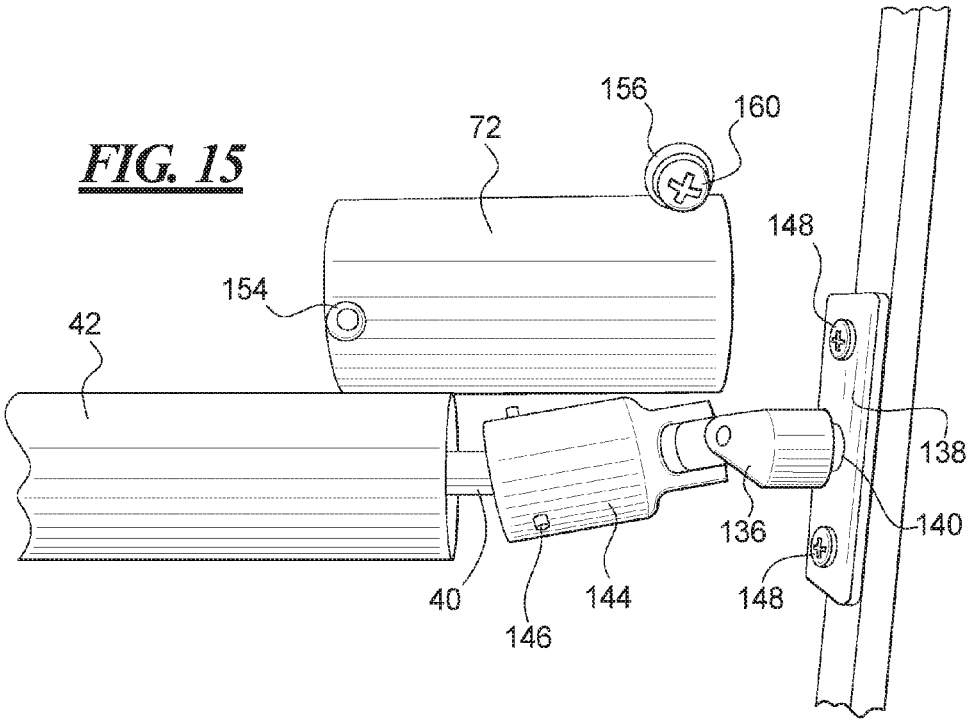
FIG. 15 is a side view of the inner mast attachment of the sail furler with the outer cylinder shown separately in side view.

In FIG. 15 shows the outer cylinder 72 removed from the universal joint 136 to show the relative sizes. The outer cylinder 72 has the fastener 154 at one end that connects the outer cylinder 72 onto the end of the cylinder 42 near the mast 18. The other end of the outer cylinder has the curved connector 160 and the rings 156 and 158. The corner of the sail may thereby be affixed to the curved connector 160 very near to the mast 18. The outer cylinder 72 covers the moving parts of the bearing barrel 144 and the universal joint 136 to keep the sail 22 from becoming entangled in the parts, such as during furling and unfurling of the sail 22.

Figure 16:
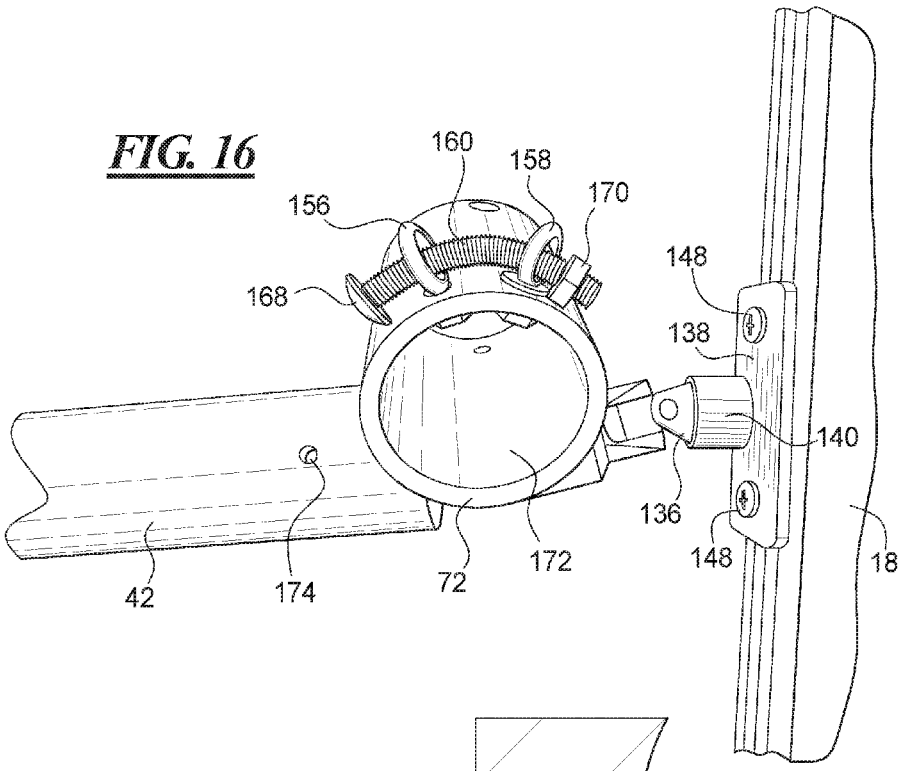
FIG. 16 is a side view of the inner mast attachment of the sail furler with the outer cylinder shown separately in end view.

In FIG. 16, the outer cylinder 72 has the first and second rings 156 and 158 mounted at locations spaced from one another about the cylindrical surface of the outer cylinder 72. The rings 156 and 158 may be welded or bolted onto the outer cylinder, or otherwise connected thereto. The curved connector 160, which may be a stainless steel screw or pin, extends through the first and second rings 156 and 158. One end of the curved connector 160 is provided with a head 168 and the other end has a nut 170 threaded onto the threaded curved connector 160. The nut 170 may be removed, the curved connector withdrawn from the second ring 158, passed through the cringle or ring of the sail 22 then passed through the second ring 158 and the nut 170 reattached. The sail 22 is thereby secured to the outer cylinder 72 and thus to the mandrel 40. Other means for fastening the sail to the cylinder 72 are possible and included in this invention.

The outer cylinder 72 is shown atop the universal joint 136 in a position transverse to the axis of the mandrel 40 for the purposes of illustrating the interior space 172 of the outer cylinder 72. The outer cylinder 72 is used in the generally co-axial position show in FIGS. 13 and 14, and is not used in the positions shown in FIGS. 14 and 15. The interior space 172 is large enough to permit the universal joint to flex during movement of the mandrel 40, such as during movement of the boom 20. The cylinder 42 includes an opening 174 into which the fastener 154 on the outer cylinder 72 may be fastened.

Figure 17:
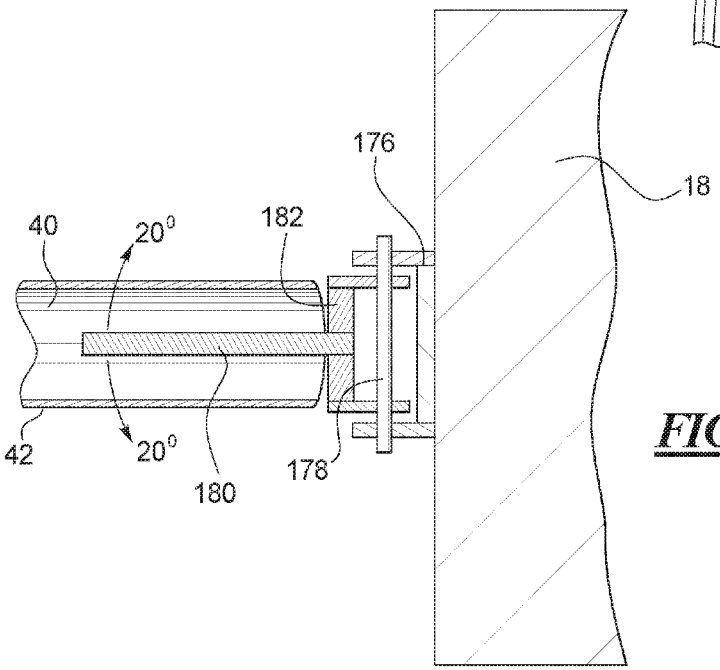
FIG. 17 is a schematic cross-sectional view of an alternate embodiment of a sail furler to mast attachment.

In FIG. 17 is shown an alternative embodiment including a mast plate 176 mounted to the mast 18. A vertical pin 178 extends through a clevis on the mast plate 176 and a clevis on a mandrel rod 180. The pin 178 permits the mandrel 40 to pivot in a horizontal plane relative to the mast 18. A bearing or bushing 182 permits rotation of the mandrel 40 for furling and unfurling the sail 22. The mandrel rod 180 is mounted in the cylinder 42 so as to permit pivoting movement by, for example, plus or minus 20 degrees to accommodate a 40 degree vertical movement of the mandrel 40.

FIG. 18 shows the tack connector or curved connector 160 in a view looking toward the mast 18. The curved connector 160 and the ring 158 are sized, shaped and positioned so that the tack eye or cringle 162 may lay flat against the outer cylinder 72 so that the sail 22 lays flat on the mandrel 40 as it is furled. The tack eye or cringle 162 extends over the ring 158 and end of the curved connector 160 and lays flat on the outer cylinder 72. The connector 160 is curved to more closely follow the contours of the outer cylinder and reduces projections that might interfere with compact, snug furling of the sail. The sail 22 may be wound or furled either clockwise or counterclockwise on the cylinder 42. The curved connector 160 and rings 156 and 158 will accommodate the tack cringle lying flat in either winding direction in a single rotation of the mandrel 40. This minimizes stress on the sail fabric will resulting in a snug furl.

In this view, the deck 52 of the sailboat 10 is visible as are the rails 184 that extend from the edges of the deck 52.

FIG. 19 shows a reefing brake 186. As discussed above, reefing the sail 22 exposes a smaller area of sail to the wind to avoid overpowering the sailboat in windy conditions. A portion of the sail 22 may be wound onto the mandrel 40 while the rest of the sail is exposed to the wind. The force of the wind on the exposed portion of the sail would tend to unwind more of the sail from the mandrel 40 if permitted. The reefing brake 186 prevents the mandrel from rotating. The reefing brake 186 includes a collar 188 fastened onto the cylinder 42. The collar 188 is fastened to a lever 190 that is mounted so as to pivot between a position generally parallel to the surface of the cylinder 42 and a position extending generally radially or perpendicular from the cylinder 42.

In the perpendicular position, the lever 190 contacts the boom 20 so that further rotation of the cylinder 42 and mandrel 40 beyond the position with the lever in contact with the boom is prevented. The mandrel 40 may rotate for a portion of a rotation until the reef brake lever 190 contacts the boom 20. To reef the sail 22, the lever 190 is moved to a position parallel with the cylinder 42, or at least out of contact with the boom 20. The crank 120 is attached to the mandrel 40 if not already attached. The mandrel 40 is rotated to take up excess sail onto the mandrel 40 of the sail furler. After a desired portion of the sail 22 is wound onto the mandrel 40, the lever 190 is pivoted to a position extending perpendicular to the mandrel 40. The sail 22 may be used with the reduced area and unwinding of the sail 22 from the mandrel 40 is prevented by the lever 190 contacting the boom 20. Winding additional sail area onto the mandrel 40 or unwinding some or all of the sail 22 is easily accomplished by pivoting the lever 190 to the parallel position and then winding or unwinding the mandrel 40 as needed.

A single lever 190 is shown which provided reefing in one turn increments. Additional levers may be provided to permit fine tuning of the reefing in increments of less than one turn. The lever 190 may be configured to restrict inadvertent pivoting by the lever such as by a high resistance pivot connection between the collar 188 and the lever 190 or by a lock or other means to hold the lever 190 in a desired position.

Figure 20:
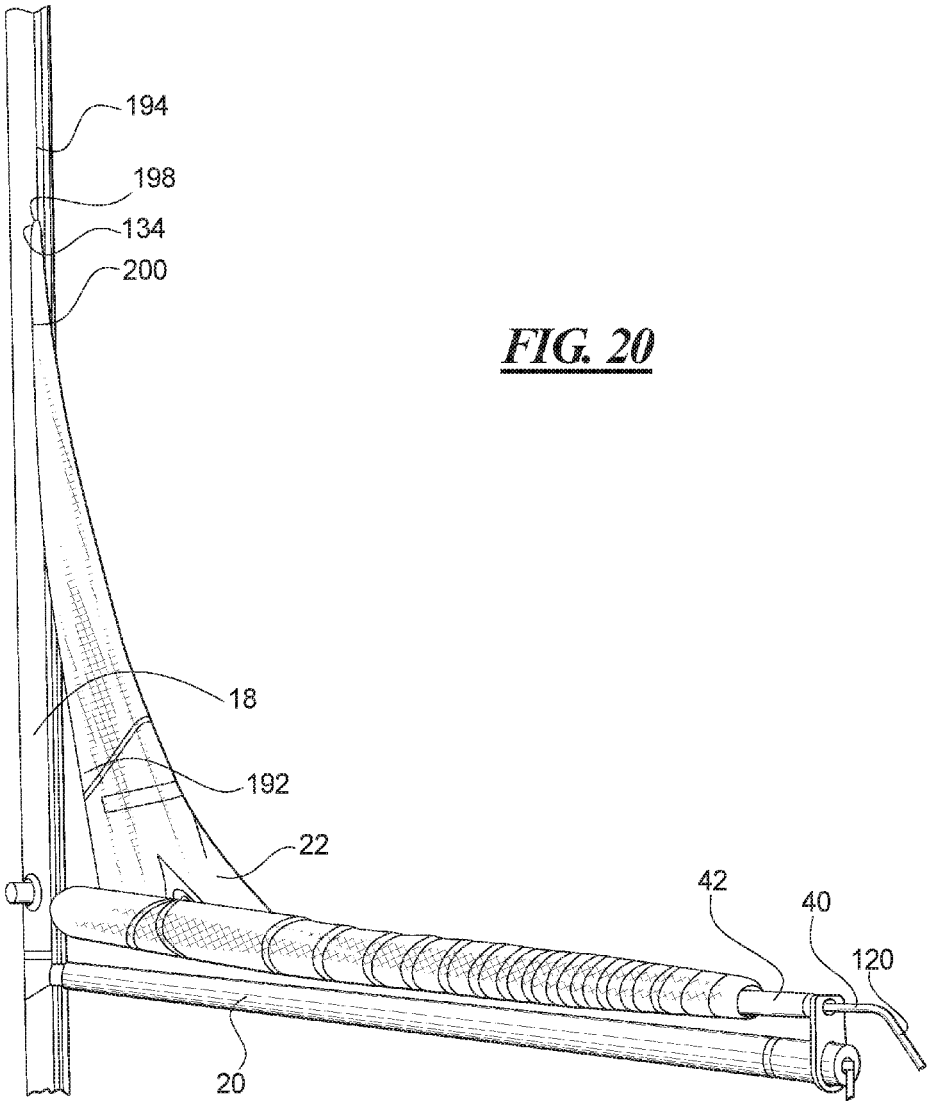
FIG. 20 is a side view of a mast and boom showing most of a mainsail wound on the sail furler.

FIG. 20 shows raising or lowering the sail 22 with luff slides or a luff rope. The fore edge of the mainsail 22 is referred to as the luff 192, which may be attached to a track 194 on the mast by slides or a rope attached to the luff edge 192 of the sail. In the illustration, a top most luff slide 134 is in the track 194. A halyard or line 198 attached to the top corner or head 200 of the sail 22 supports and moves the top corner of the sail along the mast 18. As the halyard 198 pulls the head 200 of the sail 22 upward, the mandrel 40 is turned to unwind the sail and additional luff slides 134 are fed into the track 194 until the desired amount of sail 22 is deployed.

The following describes an exemplary method for reefing or furling the sail with luff slides is described below.

1. Release the halyard to release as many luff slides from the mast track as needed for the reef. For complete furling, lower the halyard so that 4-5 luff slides are released, then raise the sail back up.
2. Adjust the boom topping lift or yang so that the angle of the boom with the mast is slightly less than 90 degrees. (i.e., the aft of the boom is slightly higher than the front of the boom).
3. Rotate the mandrel (via the crank, the furling drum, or the electric motor). With the hand crank, the mandrel can be rotated in either direction. Slowly release the halyard, keeping light tension on the line.
4. For reefing, when the mandrel is rotated to the desired number of rotations, place the braking lever in the brake position.
5. For furling, the halyard is released in multiple steps to release additional luff slides until only the final top luff slide near the peak is left.
6. The final top section of the sail is then rolled onto the mandrel.

For sails with a luff rope or luff tape, the sail can be furled or reefed by slowly rotating the mandrel to the desired number of turns.

FIG. 20 shows the sail approximately 95% furled. The top-most luff slide is maintained in the mast track. For the final furl rotations, the sail is dropped to release the last luff slide from the track. Furling the sail in this way allows the luff slides to furl a few inches aft of the gooseneck, keeping them away from back of the mast.

Figure 21:
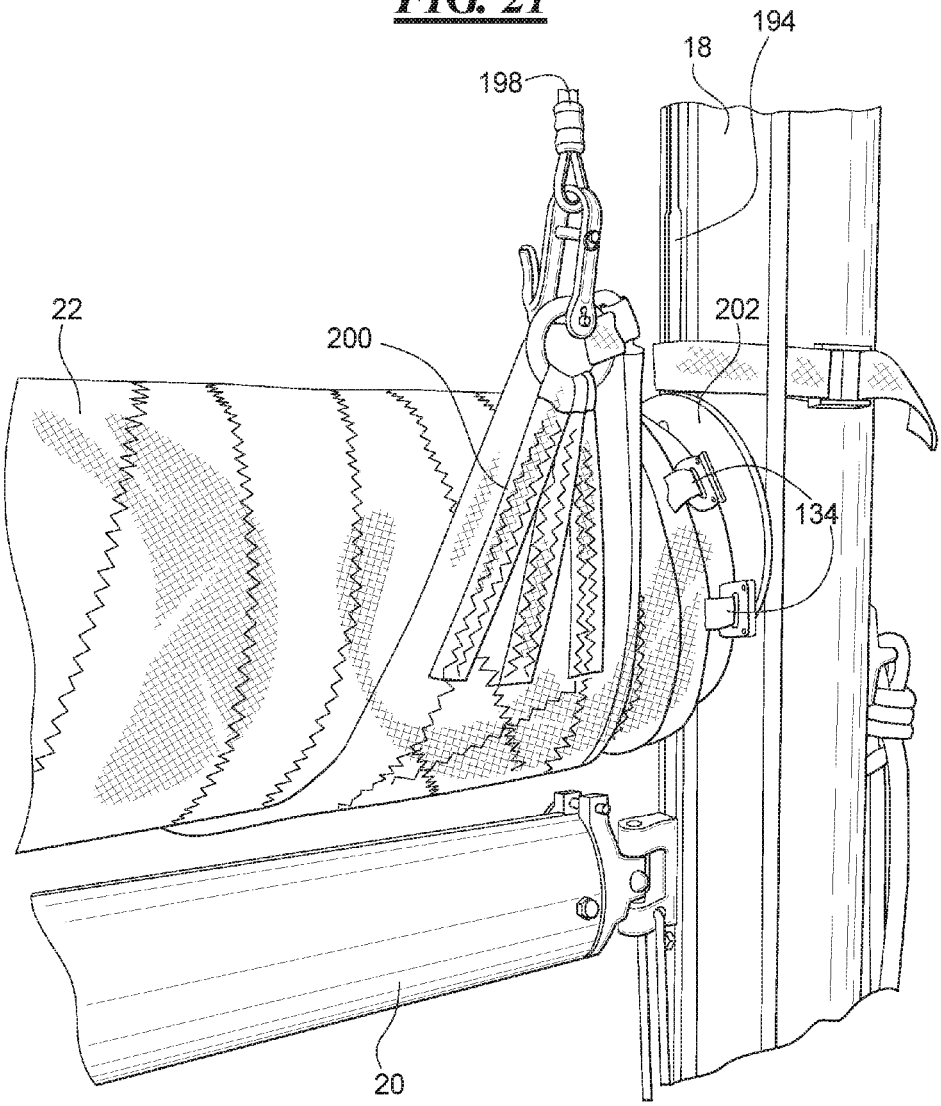
FIG. 21 is an enlarged perspective view showing an embodiment of the sail furler having a slide guard, the mainsail being fully wound onto the sail furler.

In FIG. 21 is shown an embodiment including a slide guard 202. The mainsail 22 is wound onto the mandrel 40 that is positioned above and generally parallel to the boom 20. The head or top corner 200 of the mainsail 22 is attached to the halyard or line 198 that extends to the top of the mast 18 and by which the sail is raised or lowered. The luff edge or fore edge of the sail 22 is provided with luff slides 134 that ride in the track 194 on the mast 18. The slide guard 202 of the illustrated embodiment is a circular plate mounted adjacent the mast 18 at the end of the mandrel 40. The slide guard 202 is positioned between luff slides 134 on the sail 22 and the mast 18 when the sail 22 is furled on the mandrel 40. The mandrel 40 may be rotated without the slides 134 catching on the mast 18 and in particular without the slides 134 catching in the track 194 or catching on the mast plate or other structures.

Figure 22:
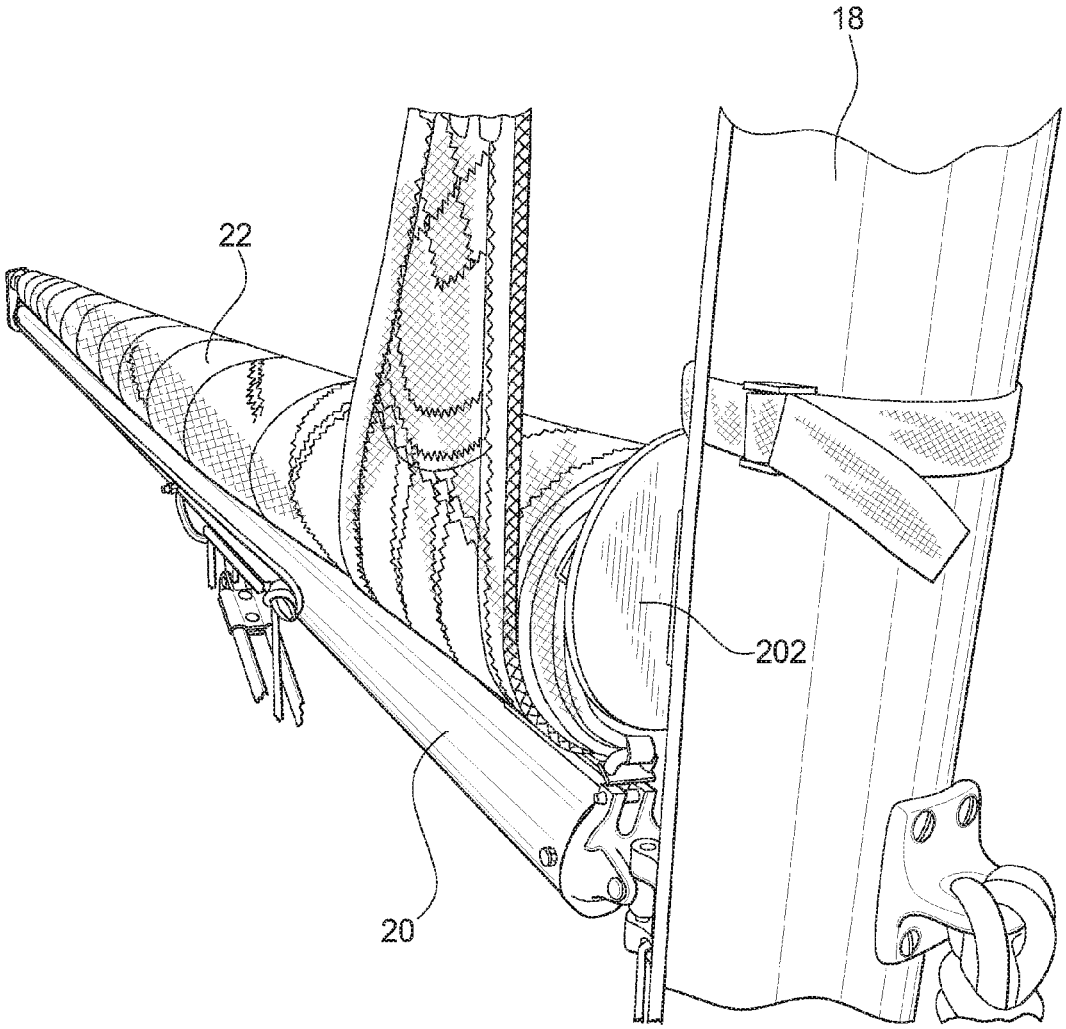
FIG. 22 is a perspective view of the sail furler and slide guard from the view of the mast.

FIG. 22 shows the slide guard 202 mounted on the mast 18 at the mandrel. The slide guard 202 is approximately the diameter of the furled sail 22 on the mandrel 40. The furled sail 22 is disposed above the boom 20.

Figure 23:
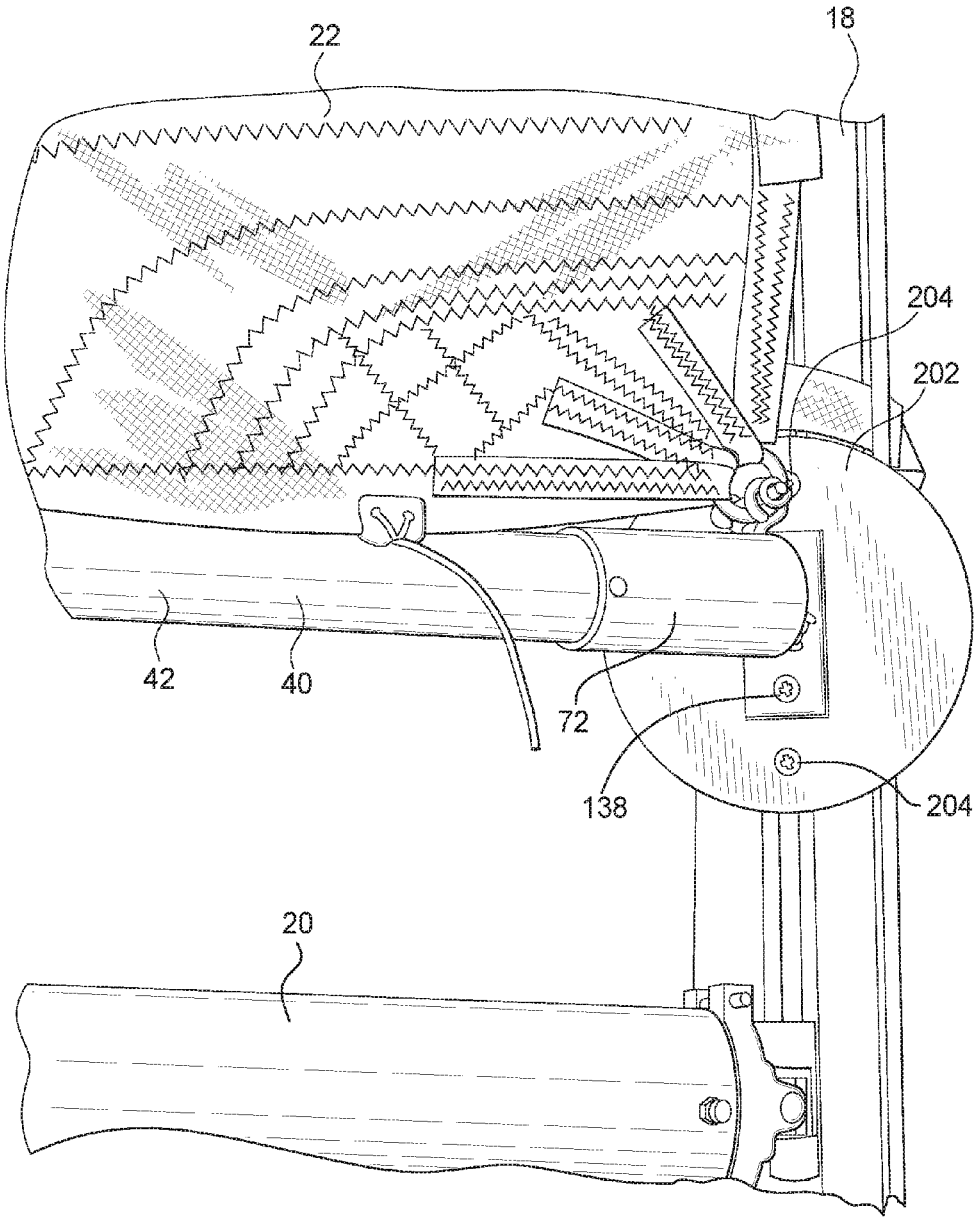
FIG. 23 is the slide guard mounted on the mast at an end of the sail furler, the mainsail being fully deployed.

In FIG. 23, the slide guard 202 is mounted on the mast 18 by fasteners 204 that extend through the slide guard 202 into the mast 18. The slide guard 202 of certain embodiments includes a cutout 206 shaped to fit over the mast plate 138. The slide guide 202 may thereby fit flush onto the mast 18. The outer cylinder 72 is shown mounted on the mandrel 40 and cylinder 42 and extending to adjacent to the slide guard 202 but with enough space to permit pivoting of the mandrel 40 as needed.

Figure 24:
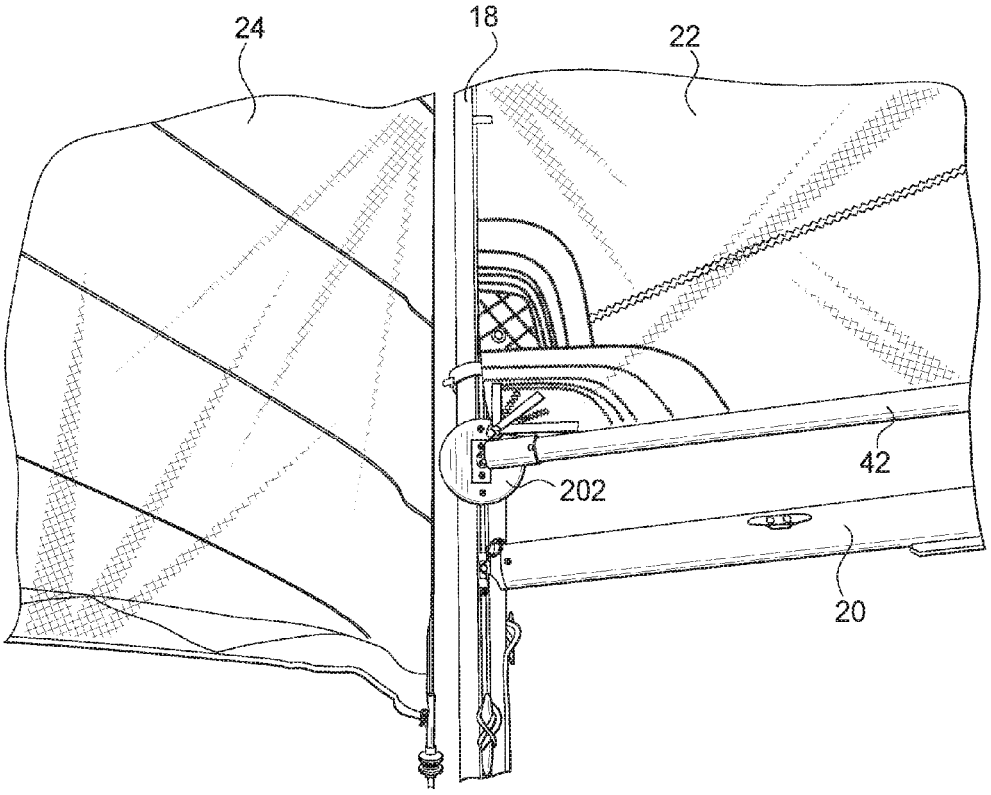
FIG. 24 is a perspective view of the mast and boom and sail furler with the slide guard plate.

Referring to FIG. 24, the sailboat 10 is shown underway with the mainsail 22 deployed above the mandrel 40 which is itself mounted on the mast 18 above the boom 20. The slide guard 202 is mounted on the mast 18. A jib sail 24 is also deployed in this view.

The mandrel 40 may be controlled by the crank 120 at the aft end of the boom 20 for furling or unfurling the sail 22, as described above. As an alternative method for furling or unfurling the sail 22, a line may be attached to the aft portion of the mandrel 40 and wound onto the mandrel like twine on a spool. The mandrel 40 may be rotated by pulling on the line. For example, the mandrel 40 may be rotated by pulling on the line to take up excess sail 22 or to completely furl the sail 22 onto the mandrel 40. The line may be wound onto the mandrel 40 as the sail 22 is deployed so that a significant number of wraps is provided on the mandrel 40 when the sail is up.

The line may extend from the mandrel 40 to the boom 20, along the boom 20 to the mast 18 and then down the mast 18 to the deck 52 through an arrangement of pulleys and guides. A sailor may furl the sail 22 onto the mandrel 40 from the deck 52 of the sailboat 10 without the need to move to the aft end of the boom or other location. The sail may be furled from the cockpit of the sailboat 10.

Figure 26:
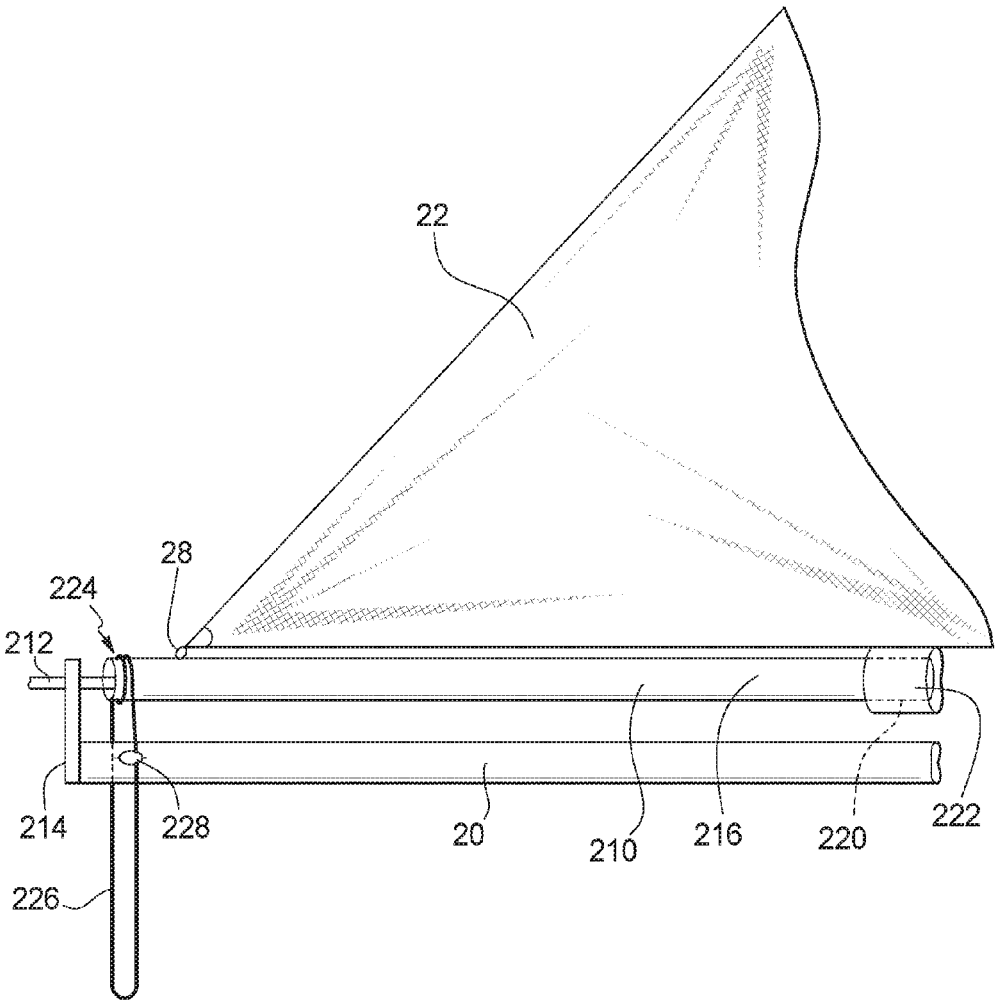
FIG. 26 is a schematic illustration of a furler spool mounted on a mandrel of a sail furler.

FIG. 26 shows an embodiment of the sail furler 210 having a mandrel 212 mounted on the boom 20 with an aft plate 214. The sail furler 210 includes a cylinder 216 mounted on the mandrel 212 to which a clew attachment 218 is provided for attaching the clew or lower aft corner of the mainsail 22. The mast end 220 of the mandrel 212 includes the barrel 222 where the mandrel 212 attaches to the mast. On the cylinder 216 between the clew attachment 218 and the aft plate 214 is provided a spool 224. A furler line 226 is connected to the spool 224. The furler line 226 of the illustrated embodiment includes a single line formed into a loop. The furler line 226 passes through a guide 228 that is mounted on the boom 20. A similar guide may be provided on the opposite side of the boom 20 through which the other side of the furler line loop 226 is passed.

The furler line 226 serves as a control line by which the mandrel 216 may be rotated. For example, the mandrel 216 may be rotated in a sail furling direction by pulling on one side of the furler line loop 226 and may be rotated in a sail unfurling direction by pulling on the other side of the furling line loop 226. The furler line 226 may be as short or as long as desired. In certain embodiments, the furler line 226 is long enough to connect to a winch (not shown) mounted in the deck of the boat 10. The winch may be used to pull the furling line 226 for furling or unfurling the sail 22 and may be able to provide greater pulling force on the line than is possible without the winch.

Figure 27:
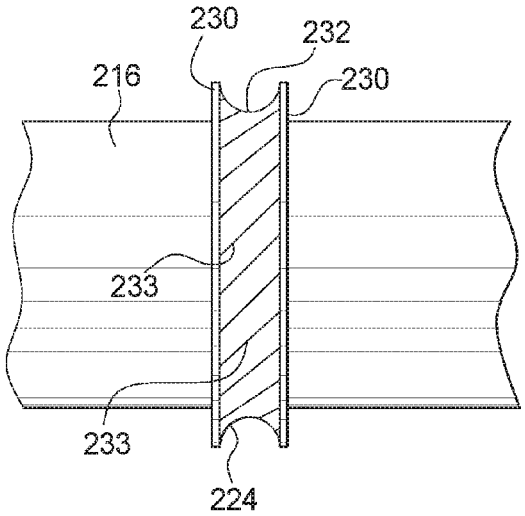
FIG. 27 is an enlarged view of the furler spool of FIG. 26.

FIG. 27 shows a close up view of the spool 224. The spool 224 is mounted on the cylinder 216 and provides outwardly extending flanges 230 that forms a groove 232 to maintain the furling line 226 on the spool 224. In certain embodiments, the groove 232 is provided with raised ridges or other shapes 233 that engage the furling line 226 to provide traction or friction between the spool 224 and the furling line 226. Slippage of the furling line 226 on the spool 224 is decreased.

The furling line 226 permits the sail 22 to be furled or unfurled without using the crank 120. The crank 120 need not be attached if it has been removed.

Figure 28:
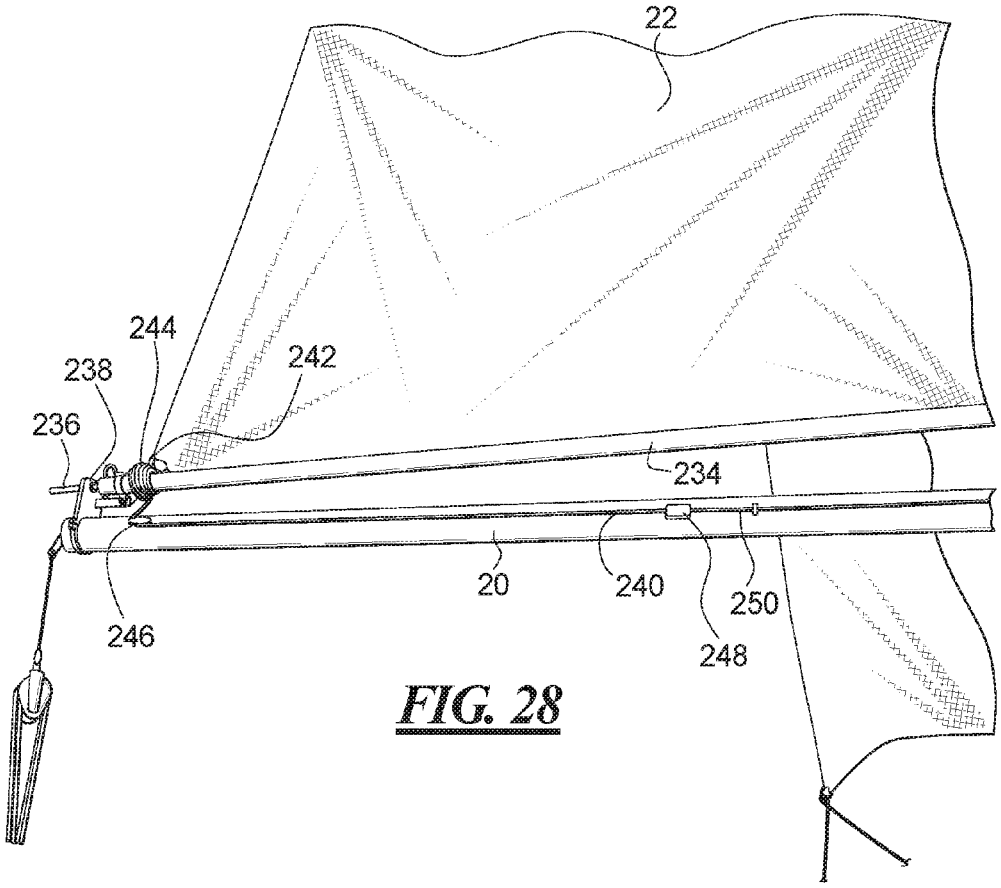
FIG. 28 is a perspective view of a boom, sail and sail furler which has been provided with a furler spool.

FIG. 28 shows a further embodiment of a furling line. In particular, the mainsail 22 is mounted on a cylinder 234 of a mandrel 236 that is mounted by an aft plate 238 to the boom 20 of a sailboat 10. A furler line 240 is wound onto the cylinder 234 between a clew attachment 242 and the aft plate 238. In the illustration a length of the furling line 240 is wound about the cylinder 234 at 244. The furling line 240 may be wound onto a spool similar to that shown in FIG. 27. The furling line 240 extends from the wound length 244 to a pulley or guide 246 on the boom 20. The furling line 240 extends along the boom 20 through additional pulleys or guides 248 and 250 toward the mast. A length of the furling line 240 may extend from the boom to the cockpit of the boat or other location, as desired. The furling line 240 may be accessed anywhere along the boom 20 or accessed at other locations for furling or unfurling some or all of the sail 22.

Figure 29:
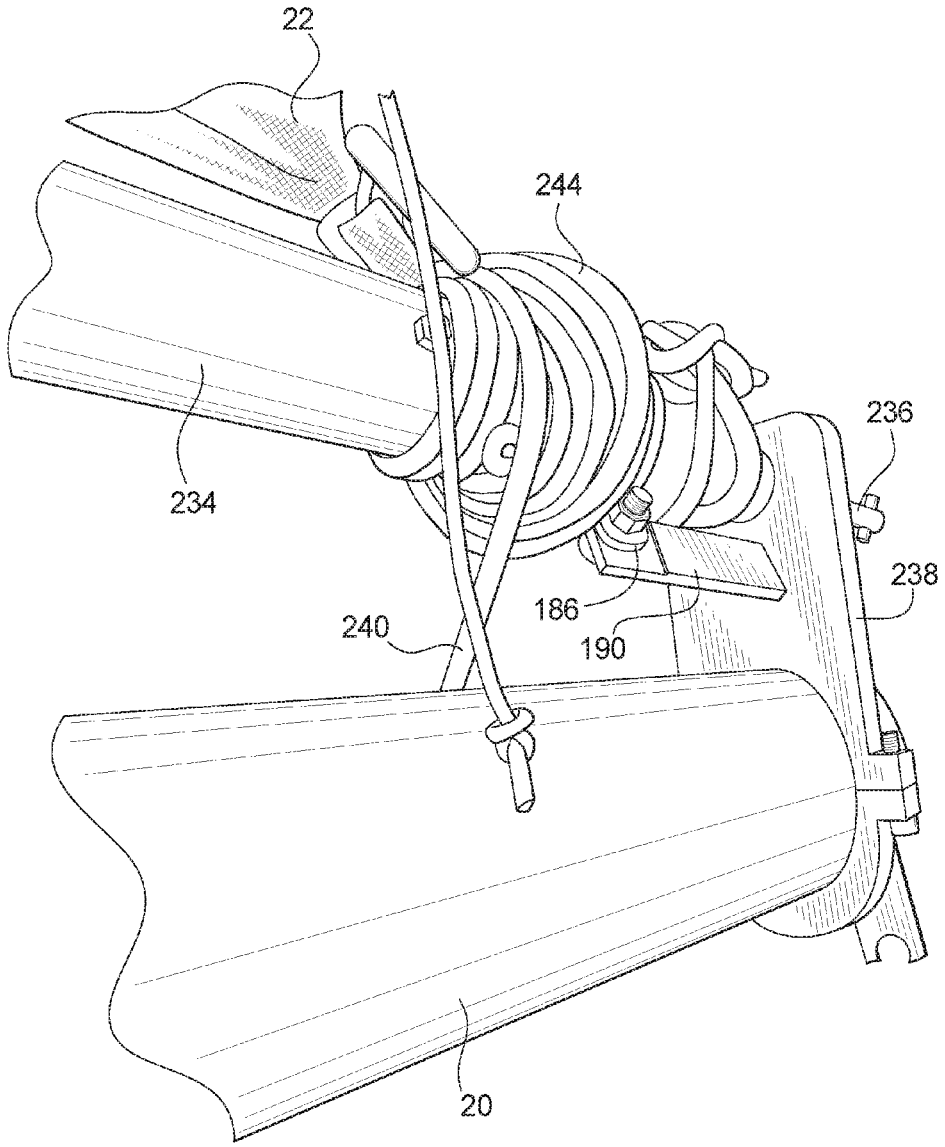
FIG. 29 is a perspective view of the aft end of the mast and sail furler on which is provided a furler spool.

FIG. 29 shows the aft end of the boom 20 with the aft plate 238 connecting the mandrel 236 to the boom 20. The cylinder 234 is mounted on the mandrel 236. The furling line 240 is wound onto the cylinder 234 at 244. As will be understood by those of skill in the art, pulling on the furling line 240 will rotate the cylinder 234 without requiring use of the crank at the end of the mandrel 236. Rotation of the cylinder 234 will roll or furl the sail 22 onto the cylinder 234. The sail 22 may be furled or unfurled as desired from a location remote from the end of the mandrel 236. The sail 22 in this view is fully extended so that pulling on the furling line 240 will result in furling or reefing of the sail 22.

Figure 30:
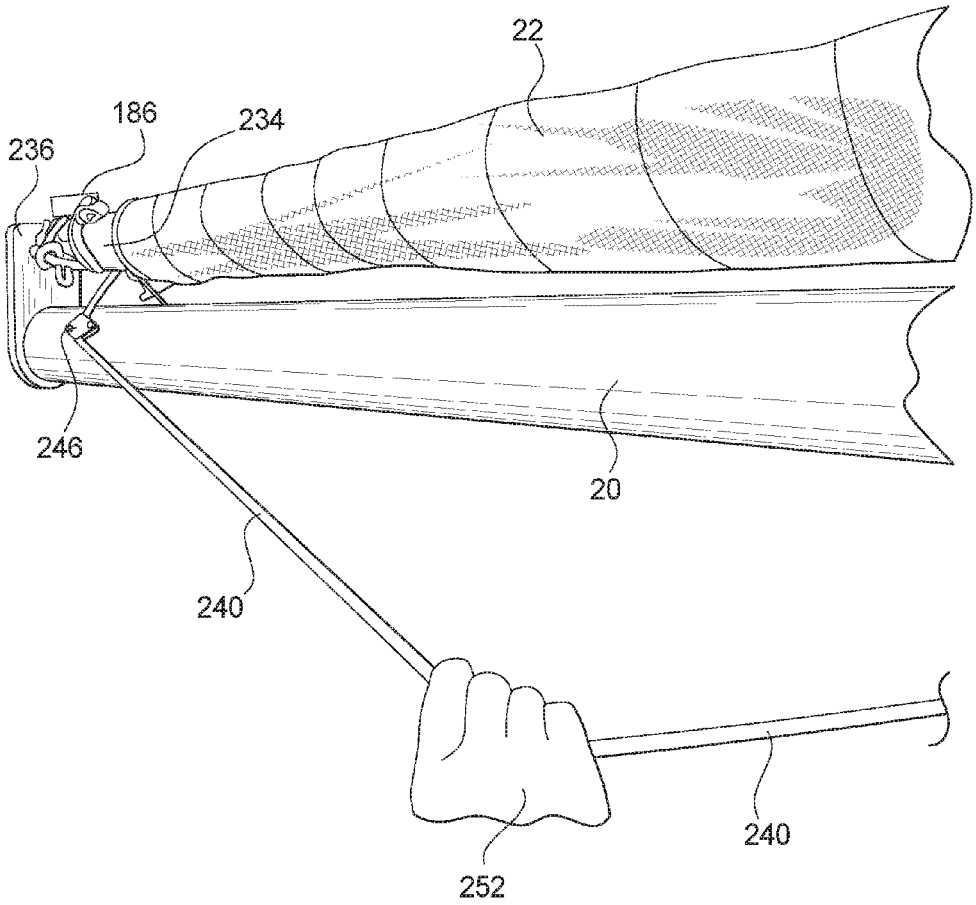
FIG. 30 is a perspective view along the boom showing the furler line being pulled.

Turning to FIG. 30, the sail 22 has been rolled or furled onto the cylinder 234. The furling line 240 is connected to the cylinder 234 between the aft end of the sail 22 and the aft plate 236. A user's hand 252 is shown pulling on a portion of the furling line 240 along the length of the boom 20 so as to exert rotational force on the cylinder 234 without the need for the user to be at the aft end of the boom 20. The pulling force by the user is transmitted from the length of furling line 240 along the boom 20 to a direction perpendicular to the cylinder 234 by the pulley or guide 246.

Figure 31:
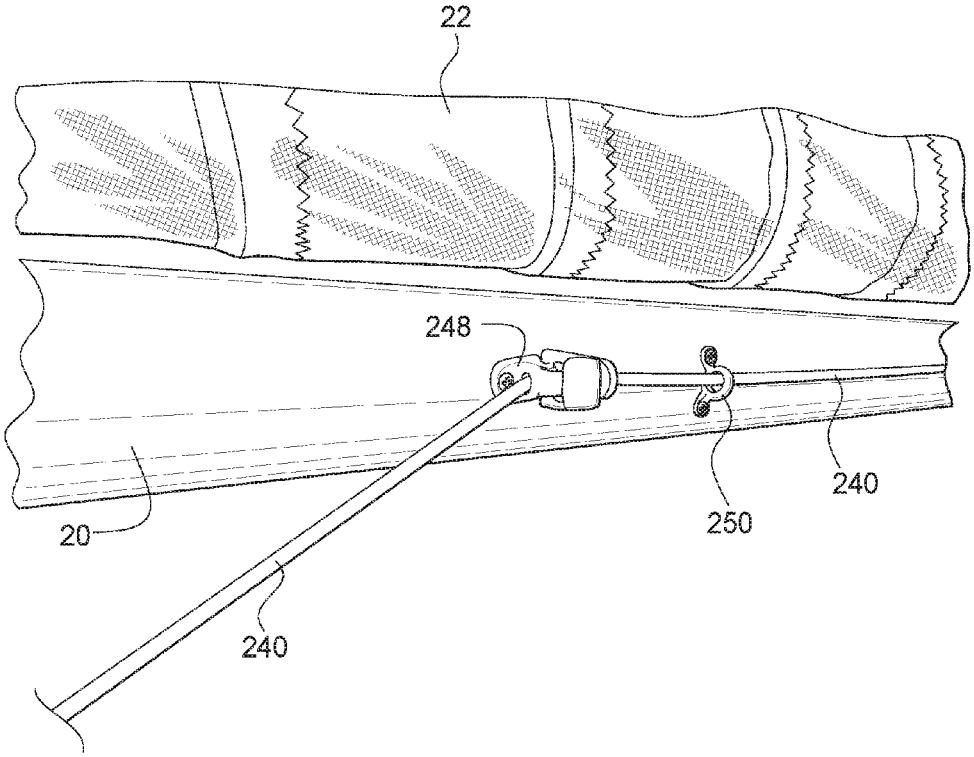
FIG. 31 is a perspective view of the furler line mounted on the boom.

FIG. 31 shows the boom 20 extending toward the mast 18. The sail 22 is furled onto the cylinder 234. The furling line 240 extends along the boom 20 and passes through a guide 248 and a guide 250. The guide 248 of the illustrated embodiment is a locking guide that is operated by the user to selectively lock the furling line 240. For example, the locking guide 248 may be a one-way lock, such as a spinlock, that permits the furling line 240 to be pulled through the guide 248 in one direction but which prevents the line from being pulled through in the other direction when in a locked condition.

The one way lock guide 248 permits the user to exert a pulling force on the furling line 240 by pulling the length of furling line 240 between the pulley 246 and the locking guide 248 away from the boom 20, for example as shown in FIG. 30. The lateral or downward pulling force is translated into rotational force on the mandrel. In certain embodiments, the mandrel may be rotated by two to three rotations with a single pull on the furling line 240. After pulling the furling line 240 away from the boom 20, there is slack in the line aft of the locking guide 248. The slack is taken up by pulling on the furling line 240 at the fore side of the locking guide 248 so that the line moves through the locking guide 248 in its free moving direction. By repeating the lateral pull and take up slack steps, the sail may be partially or entirely furled onto the sail furler for example from the deck of the sailboat.

When in the locked condition, the locking guide 248 prevents the line from being pulled through the locking guide during a lateral pull on the line by the user and also prevents the line from being pulled back through the locking guide by tension on the line while still permitting slack line to be taken up. The locking guide 248 may be unlocked by the user to permit free movement of the line 240 in both directions so that the line may pass freely through the guide during unfurling of the sail 22, for example. Other guides and/or line locks may be used instead or in addition to the examples shown.

The furling line 240 may be wound onto the cylinder 234 in a direction so that pulling the furling line results in the sail 22 being furled onto the cylinder 234, retracting the sail. Unfurling of the sail 22 may be accomplished by the force of the wind onto the sail or by hoisting the sail using the halyard. Unfurling forces by the wind may be countered by the user maintaining force on the furling line. It is also possible to wind the furling line 230 onto the cylinder 234 so that pulling on the furling line 240 unwinds or unfurls the sail 22 from the cylinder 234. It is possible that two furling lines may be provided, one for furling the sail and the other for unfurling the sail 22.

Thus, there is shown an apparatus for furling and reefing of the mainsail. In certain embodiments, the furling of the sail may be accomplished without leaving the cockpit of the boat. The sail can be stored in a rolled fashion, which improves the life of the sail. The apparatus may comprise a mandrel that rotates on bearings that are fixed by way of a plate attached to the aft end of a conventional boom and an inner universal joint attached to the back of the mast. The mainsail attaches to the apparatus at two corners, the clew and the tack, and possibly at additional attachment locations along the mandrel. Once attached, the apparatus can furl and/or reef the mainsail by rolling the sail onto the mandrel. This may be done by turning a hand crank attached to the aft of the mandrel, by pulling a rope attached to the boom, by activating an electrical motor that rotates the mandrel, or by other rotating means.

The native boom is fully functional at all points of sail as the apparatus does not interfere with attachments to the boom such as the mainsheet and boom yang. The apparatus can be used to furl any sail that uses a boom and a mast (i.e., jib, mizzen, etc.)

Certain embodiments of the apparatus may comprise four components, the mandrel, the aft plate, the inner mast attachment, and the reefing brake. In certain embodiments, the present sail furler can perform all the functions of the other furler devices at a fraction of the cost. Certain embodiments can be completely removed by removing four machine screws, allowing the owner to restore the original mainsail system. This may be useful for sailors who prefer roller furling for cruising and the conventional system for racing. The apparatus also can be used with the standard mainsail without expensive modifications to the sail.

The following summarizes features of the components according to certain embodiments.

Mandrel:

The mandrel may be an elongated rod to which the mainsail is attached that allows the sail to be rolled. The mandrel may be composed of an inner solid stainless steel or carbon fiber rod of a length that is approximately 6-12 inches longer than the sailboat boom. This extra length allows for the attachment of the hand crank or furling drum on the aft end of the mandrel. The rod may be ½-¾ inch in diameter. Within this inner rod are drilled various small holes for placing of pins. The pins attach the following components to the inner rod: the aft hand crank, the aluminum cylinder, the outer cylinder, and the inner mast attachment. Surrounding the stainless steel rod is an aluminum cylinder which is cut approximately one foot longer than the length of the sail foot (the horizontal base of the sail) and approximately one foot shorter than the stainless steel rod. The cylinder may be fixed to the stainless steel rod with solid spacers made of plastic or hardwood that are placed at intervals along the length of the mandrel. The spacers have an outer diameter equal to the inner diameter of the cylinder and a central hole equal to the diameter of the stainless steel rod. The spacers may be glued and/or pinned transversely though the cylinder, the spacer and the inner stainless steel rod. The spacers provide stiffness to the mandrel so that a rotational force exerted on inner rod is transmitted evenly to the outer cylinder, allowing for furling and/or reefing of the sail.

The mandrel may rotate on two bearings, one located in the aft plate and one in the inner mast attachment. Both bearings can be standard roller bearings or swivel (spherical) bearings. The mandrel may be rotated by a crank handle, by a furling drum or by an electric motor. These devices are located at the aft plate (all devices) or to the mast attachment (electric motor only). Attached to the aft portion of the mandrel is a brake lever, that when placed in the brake position, halts rotation of the mandrel by engaging the boom. The brake lever is used for reefing the sail.

The sail is attached to the mandrel at the clew and tack ends of the sail using the standard eyes (cringles). For the clew end, an outhaul line is threaded through the cringle and through an eye or cleat on the aft end of the mandrel. This allows for adjusting the tension on the foot of the sail. For brisk wind conditions, an additional strap is placed through the cringle around the mandrel and tightened. This prevents upward movement of the clue cringle.

The clew of the sail may be attached to the mandrel. The clew topping lift (the slack line) and the foam rubber outer sleeve may be provided on the mandrel. Depending on the cut of the sail, the foam sleeve can extend the full length of the foot or partial length. The foam sleeve allows for the sail to furl evenly along the mandrel, preventing creases. For sails with luff slides, the foam rubber sleeve places mild tension on the leech of the sail during furling. This tension allows the luff of the sail to roll onto the mandrel slightly aft of the mast attachment. This prevents the luff slides from getting caught in the rotational movement of the mandrel. If the sail is fitted with a luff tape instead of luff slides, this may also allow for smoother raising and lowering of the sail.

The furler does not interfere with the functionality of the boom, such as the boom yang or main sheet.

Outer Cylinder of the Mandrel:

The mast-end of the mandrel may comprise of an outer cylinder made of hardened metal or carbon fiber of 6-12 inches in length. This outer cylinder attaches snugly to the forward end of the mandrel and has hardware that allows for attachment of the tack eye of the sail. This outer cylinder provides sufficient space within the lumen of the cylinder to house the inner universal joint. This allows these parts to rotate freely. This design also allows the tack eye of the sail to be placed within one inch of the back of the mast. The close proximity of the tack connector to the mast may reduce traction on the luff of the sail.

The Aft Plate:

The aft plate is the aft attachment for the mandrel to the boom. The aft plate may be made of aluminum, stainless steel, carbon fiber, or composite of ½ to 1 inch in thickness. The lower aspect of the plate is custom-cut to exactly match the outer shape of the boom (round, oval, hexagonal, etc). This plate tightly attaches to the outer aspect of the boom using machine screws. The upper aspect of the aft plate is cut to hold a bearing through which the stainless steel inner rod is held. The bearing may be placed at a position of 3-6 inches above the top of the boom, facing fore/aft. The bearing may be placed in such a way that the stainless steel rod can both freely rotate within the bearing and can slide forward and aft within the bearing as the boom is lifted or lowered. An alternative aspect of the aft plate is similar to above, but has a hinge placed transversely between the hole for the boom and the bearing. The hinge may allow for bending of the aft plate both forward and aft. This will help reduce stress to the plate when the back of the boom is lifted or lowered and would eliminate the need to have the inner rod of the mandrel to slide through the bearing in the aft plate. The aft plate, if it is hinged, would allow the plate to move forward and aftward by as much as 20 degrees, as illustrated below.

This 20 degree movement would be sufficient for most sailboats and would prevent the need of the stainless steel rod of the mandrel to slide within the bearing of the aft plate with an upward or downward tilt in the boom. A downward boom tilt causes the aft plate to pull the plate forward by x degrees. Similarly, as the boom is elevated, the corresponding angle of the aft plate will increase to 180-x degrees, pushing the plate aftward. A hinged plate that allows 20 degree forward and aft movement will accommodate these motions.

Additionally, using a hinged plate, it is also possible to have the mandrel supported at both the aft and the mast end of the boom—i.e., two-hinged plate. As the boom tilts downward, both hinges would bend forward by the force of the tack attachments of the sail to the mast. As the boom tilts upward, both hinges would bend aft to prevent the mast plate from jamming the mast. The two plates would hold the mandrel.

Another alternative aspect of the aft plate is that several plates can be pre-manufactured for various boom sizes. To accommodate a specific boom, a plastic insert can be custom made to the specific boom. The insert may be then fitted into a groove within a pre-cut hole of the aft plate to make the finished product.

The materials and fastenings of the aft plate are designed to withstand the full upward, sideward, aft and forward forces of the normal clew attachment under full sail and high wind conditions.

In one example the aft plate for a Catalina 27 sailboat includes a oval hole to accommodate the exact shape of a Catalina 27 boom (3.5 vertical×2.75 inches horizontal). For this plate, there is no plastic insert. The hole cut in the top of the plate holds the bearing that accommodates the inner steel rod.

The hand crank may be attached to the back of the mandrel. The crank may be kept in place during furling and may be detached at all other times. The clue eye (cringle) of the sail is attached to the mandrel with non-stretch rope (the outhaul). An aft spacer may be provided inside the aft end of the outer cylinder of the mandrel.

Inner Mast Attachment and Mast Plate:

The inner mast attachment has a universal joint that allows for lateral swing of the mandrel to an angle of 90 degrees to port and starboard of the mast as well as upward and downward swing. The inner mast attachment of certain embodiments comprises the following: a steel barrel that holds the bearing, a bearing; and a steel universal joint.

The forward end of the stainless steel inner rod fits into the bearing of the inner piece of the mast attachment. The bearing may be held within the steel barrel by steel pins. The forward end of stainless steel rod may be held within the inner piece by a metal retaining ring.

The inner universal joint may be attached to the back of the mast with a small plate of stainless steel to which may be attached a "cube" of ½ inch to 1 inch steel. The end of the universal joint fits snugly onto the cube and may be held by a retaining screw.

The vertical distance between the gooseneck of the native boom and the mast attachment may be adjusted to accommodate the needs of the sailor and other conditions. For example, when the sail is fully furled, the distance may be 4 to 12 inches to accommodate the thickness of the furled sail on the mandrel. When the sail is fully raised, the gooseneck may slide upward to closely abut the mandrel. This position may provide more headroom for the sailors. A web strap can also be wrapped and tightened around the mandrel and gooseneck to provide additional stability during windy conditions. The spherical roller bearing in the aft plate allows for such vertical movement.

The outer cylinder according to one embodiment has a large inner diameter of the outer cylinder that allows the inner universal joint to rotate freely within it. The outer cylinder may be cut to a length that completely encloses the universal joint and barrel. This design allows for the tack connector to be placed very close to the back of the mast.

The inner universal joint and mast attachment may also be modified as follows: the mast portion of the mandrel may hold the bearing inside the mandrel and not have an inner steel rod; and/or the attachment of the mandrel to the mast may comprise of a steel rod that pivots on a mast fitting and may insert into the bearing in the mandrel. The mast fitting may allow for 180 degree movement left to right and 20 degree movement up and down of the steel rod. As in the original apparatus, the outer cylinder fits over the mast attachment.

Tack Connector:

The tack connector includes the two metal eyes that may be bolted or welded into the outer cylinder at a distance that allows the tack eye to easily fit between them. The tack eye may be fastened to the connector by a stainless steel screw or pin that is bent to accommodate the curvature of the outer cylinder. The tack eye may also be attached to the connector with non-stretchable rope. The shape of the connector allows for the tack eye of the sail to lie flat onto the outer piece when furled, as seen in this figure. With a partial rotation of the mandrel, the tack eye of the sail falls flat over one of the connector eyes of the outer cylinder, allowing for a snug furl.

The design allows for furling either clockwise or counter-clockwise direction. The figure also shows the mast attachment plate.

The Reefing Brake:

Reefing the sail provides a smaller sail area that is exposed to the wind. This prevents the sailboat from being overpowered in windy conditions. The reefing brake may be composed of a stainless steel lever and a steel collar that snugly fits around the aft of the mandrel. The lever is a length sufficient to extend from the aft section of the mandrel to the boom. The steel lever can rotate from a position that is parallel to the mandrel to a perpendicular position. When placed in the perpendicular position, the lever engages the boom and prevents further rotation of the mandrel. The brake is used for reefing the sail. To reef the sail, the sail mandrel may be rotated manually to take up (reef) excess sail. After completing the rotations, the brake lever may be rotated from the parallel position to the perpendicular position, as shown in the figure below:

For all components listed above, various materials are contemplated, but this is not meant to be limiting. Any material may be used that can meet the demands of the loads from the sail. It should be apparent to those skilled in the art that many more modifications besides those already described are possible without departing from the inventive concepts herein. The method of manufacture and design is not intended to be limited. The inventive subject matter, therefore, is not to be restricted. Obviously, modifications and alterations will occur to others upon reading and understanding the preceding detailed description. It is intended that the invention be construed as including all such modifications and alterations insofar as they come within the scope of the appended claims or the equivalents thereof.

Thus, there is shown and described a sail furler for a sail boat and method for furling a sail for reefing or storage and for unfurling a sail for use. Furling and unfurling of the sail may be accomplished from the cockpit of the sailboat. A mandrel is mounted to the mast extending generally parallel to the boom and attached to the aft end of boom by an aft plate. The mandrel is mounted in bearings and provided with a removable crank for rotation. The mandrel is connected to the mast by a universal joint and bearing structure over which is provided an outer cylinder. A cylinder and resilient sleeve may be provided on the mandrel. A reef brake extends from the mandrel into contact with the boom to prevent rotation for reefing the sail. A slide guard may be mounted at the mast end of the mandrel.

Although other modifications and changes may be suggested by those skilled in the art, it is the intention of the inventors to embody within the patent warranted hereon all changes and modifications as reasonably and properly come within the scope of their contribution to the art.

I claim:

1. A sail furler, comprising:

a mandrel having a first end and a second opposite end, the mandrel being configured for attaching to a sail of a sailboat;

an aft plate at the first end of the mandrel, the mandrel being rotatable relative to the aft plate, the aft plate being configured for mounting the mandrel in parallel to a boom or spar of a sailboat;

a bearing at the second end of the mandrel, the bearing being configured for mounting the second end of the mandrel to a mast of the sailboat in parallel to the boom or spar, the mandrel being rotatable in the bearing;

a rotating apparatus connected to the mandrel at the first end of the mandrel, the rotating apparatus being operable to rotate the mandrel so as to selectively furl the sail onto the mandrel or unfurl the sail from the mandrel.

2. A sail furler, comprising:

a mandrel having a first end and a second opposite end, the mandrel being configured for attaching to a sail of a sailboat;

an aft plate at the first end of the mandrel, the mandrel being rotatable relative to the aft plate, the aft plate being configured for mounting to a boom or spar of a sailboat;

a bearing at the second end of the mandrel, the bearing being configured for mounting to a mast of the sailboat, the mandrel being rotatable in the bearing;

a rotating apparatus connected to the mandrel at the first end of the mandrel, the rotating apparatus being operable to rotate the mandrel so as to selectively furl the sail onto the mandrel or unfurl the sail from the mandrel; and a cylinder on the mandrel, the sail being attached to the mandrel by being attached to the cylinder.

3. A sail furler as claimed in claim 2, further comprising:

a plurality of spacers extending between the mandrel and the cylinder, the spacers being disposed at spaced locations along a length of the mandrel.

4. A sail furler, comprising:

a mandrel having a first end and a second opposite end, the mandrel being configured for attaching to a sail of a sailboat;

an aft plate at the first end of the mandrel, the mandrel being rotatable relative to the aft plate, the aft plate being configured for mounting to a boom or spar of a sailboat;

a bearing at the second end of the mandrel, the bearing being configured for mounting to a mast of the sailboat, the mandrel being rotatable in the bearing; and a rotating apparatus connected to the mandrel at the first end of the mandrel, the rotating apparatus being operable to rotate the mandrel so as to selectively furl the sail onto the mandrel or unfurl the sail from the mandrel, the rotating apparatus including a crank removably attached to the first end of the mandrel.

5. A sail furler as claimed in claim 1, wherein the rotating apparatus includes a furling line selectively wound around the mandrel.

6. A sail furler as claimed in claim 5, further comprising:

a plurality of guides configured for mounting onto the boom of the sailboats so that the furling line extends through the plurality of guides on the boom and along the boom.

7. A sail furler, comprising:

a mandrel having a first end and a second opposite end, the mandrel being configured for attaching to a sail of a sailboat;

an aft plate at the first end of the mandrel, the mandrel being rotatable relative to the aft plate, the aft plate being configured for mounting to a boom or spar of a sailboat;

a bearing at the second end of the mandrel, the bearing being configured for mounting to a mast of the sailboat, the mandrel being rotatable in the bearing;

a rotating apparatus connected to the mandrel at the first end of the mandrel, the rotating apparatus being operable to rotate the mandrel so as to selectively furl the sail onto the mandrel or unfurl the sail from the mandrel, the rotating apparatus includes a furling line selectively wound around the mandrel;

a plurality of guides configured for mounting along the boom of the sailboats so that the furling line extends through the plurality of guides and along the boom; and a line gripper configured for mounting on the boom of the sailboat and for receiving the furling line, the line gripper being selectively operable to grip the furling line.

8. A sail furler, comprising:

a mandrel having a first end and a second opposite end, the mandrel being configured for attaching to a sail of a sailboat;

an aft plate at the first end of the mandrel, the mandrel being rotatable relative to the aft plate, the aft plate being configured for mounting to a boom or spar of a sailboat;

a bearing at the second end of the mandrel, the bearing being configured for mounting to a mast of the sailboat, the mandrel being rotatable in the bearing;

a rotating apparatus connected to the mandrel at the first end of the mandrel, the rotating apparatus being operable to rotate the mandrel so as to selectively furl the sail onto the mandrel or unfurl the sail from the mandrel, a spherical bearing mounted in the aft plate, the mandrel extending though the spherical bearing; and a hinge in the aft plate disposed for selective pivoting of a first portion of the aft plate relative to a second portion of the aft plate.

9. A sail furler, comprising:

a mandrel having a first end and a second opposite end, the mandrel being configured for attaching to a sail of a sailboat;

an aft plate at the first end of the mandrel, the mandrel being rotatable relative to the aft plate, the aft plate being configured for mounting to a boom or spar of a sailboat;

a bearing at the second end of the mandrel, the bearing being configured for mounting to a mast of the sailboat, the mandrel being rotatable in the bearing;

a rotating apparatus connected to the mandrel at the first end of the mandrel, the rotating apparatus being operable to rotate the mandrel so as to selectively furl the sail onto the mandrel or unfurl the sail from the mandrel, a universal joint connected to the second end of the mandrel; and a mast plate connected to the universal joint, the mast plate being configured for mounting to the mast of the sailboat.

10. A sail furler as claimed in claim 9, further comprising:

a sleeve mounted over the universal joint.

11. A sail furler as claimed in claim 10, further comprising:

first and second rings mounted to the sleeve at spaced locations; and a connector extending through the first and second rings, the connector being configured for receiving an eye of the sail.

12. A sail furler as claimed in claim 11, wherein the first and second rings extend radially from the sleeve; and wherein the connector extending through the first and second rings is a curved connector.

13. A sail furler as claimed in claim 1, further comprising:

a reefing brake mounted to the mandrel, the reefing brake being operable to selectively engage the boom mounted parallel to the mandrel to inhibit unfurling of the sail by inhibiting rotation of the mandrel.

14. A sail furler, comprising:

a mandrel having a first end and a second opposite end, the mandrel being configured for attaching to a sail of a sailboat;

an aft plate at the first end of the mandrel, the mandrel being rotatable relative to the aft plate, the aft plate being configured for mounting to a boom or spar of a sailboat;

a bearing at the second end of the mandrel, the bearing being configured for mounting to a mast of the sailboat, the mandrel being rotatable in the bearing;

a rotating apparatus connected to the mandrel at the first end of the mandrel, the rotating apparatus being operable to rotate the mandrel so as to selectively furl the sail onto the mandrel or unfurl the sail from the mandrel; and a reefing brake mounted to the mandrel, the reefing brake being operable to selectively inhibit unfurling of the sail by inhibiting rotation of the mandrel, the reefing brake including:

a reef brake lever mounted for pivoting movement between a first position and a second position, the reef brake lever being disposed parallel to the mandrel in the first position, the reef brake lever extending radially from the mandrel in the second position.

15. A sail furler, comprising:

a mandrel having a first end and a second opposite end, the mandrel being configured for attaching to a sail of a sailboat;

an aft plate at the first end of the mandrel, the mandrel being rotatable relative to the aft plate, the aft plate being configured for mounting to a boom or spar of a sailboat;

a bearing at the second end of the mandrel, the bearing being configured for mounting to a mast of the sailboat, the mandrel being rotatable in the bearing;

a rotating apparatus connected to the mandrel at the first end of the mandrel, the rotating apparatus being operable to rotate the mandrel so as to selectively furl the sail onto the mandrel or unfurl the sail from the mandrel; and a slide guard mounted at the second end of the mandrel, the slide guard extending radially from the mandrel, the slide guard being configured for mounting to the mast.

16. A sail furler as claimed in claim 1, wherein the sail furler is configured for retrofit onto an existing sailboat.

17. A sail furler as claimed in claim 1, wherein the sail furler is mounted on a new sailboat as original equipment.

18. A sail furler for use on a sailboat having a mast and a boom and a sail, comprising a mandrel having a first end and a second opposite end;

a cylinder mounted coaxially with the mandrel so that the first end of the mandrel extends from the cylinder;

an aft plate having an aft plate bearing, the first end of the mandrel extending through the aft plate bearing, the aft plate bearing being constructed to permit rotation of the mandrel in the aft plate, the aft plate being configured for mounting to a boom of a sailboat;

a crank selectively connectable to the first end of the mandrel;

a universal joint connected to the second end of the mandrel, the universal joint including a bearing constructed to permit rotation of the mandrel relative to the mast of the sailboat;

a mast plate configured for mounting to the mast of the sailboat, the universal joint being connected to the mast plate;

a sleeve mounted on the cylinder and extending over the universal joint; and a sail connecting apparatus on the sleeve.

19. A sail furler as claimed in claim 18, further comprising:

a furling line connected to the cylinder and operable to rotate the mandrel in the aft plate.

20. A sail furler as claimed in claim 18, further comprising:

a reefing brake connected to the cylinder, the reefing brake including a reef brake lever mounted for pivoting movement between a retracted position and an extended position, wherein the extended position is configured for contact with the boom of the sailboat.

21. An apparatus for controlling a foot of a sail, comprising:

a first elongated member mounted connected to the foot of the sail at a plurality of connection locations along the first elongated member, the first elongated member being rotatable so that the foot of the sail wraps around the first elongated member, the first elongated member having a first end;

a second elongated member disposed parallel to and spaced from the first elongated member, the second elongated member having a first end;

a connector connecting the first end of the first elongated member to the first end of the second elongated member;

at least one line connected to the second elongated member to control a vertical and horizontal position of the second elongated member; and the second elongated member controlling a vertical and horizontal position of the first elongated member.

* * * * *